US009810494B1

(12) United States Patent
Huang

(10) Patent No.: US 9,810,494 B1
(45) **Date of Patent: *Nov. 7, 2017**

(54) CHARGING HANDLE FOR A FIREARM

(71) Applicant: George Huang, Henderson, NV (US)

(72) Inventor: George Huang, Henderson, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/450,754

(22) Filed: Mar. 6, 2017

Related U.S. Application Data

(63) Continuation of application No. 15/001,000, filed on Jan. 19, 2016, now Pat. No. 9,587,896.

(60) Provisional application No. 62/105,274, filed on Jan. 20, 2015.

(51) Int. Cl.
*F41A 3/72* (2006.01)
*F41A 35/06* (2006.01)

(52) U.S. Cl.
CPC ..... *F41A 3/72* (2013.01); *F41A 35/06* (2013.01)

(58) Field of Classification Search
CPC .... F41A 3/72; F41A 3/20; F41A 35/06; F41A 7/00; F41A 7/02; F41A 9/00; F41A 9/38
See application file for complete search history.

(56) References Cited

U.S. PATENT DOCUMENTS 7,240,600 B1 * 7/2007 Bordson ..... F41A 3/72 42/69.01
7,707,921 B1 * 5/2010 Hoel ..... F41A 3/20 42/16
7,832,322 B1 * 11/2010 Hoel ..... F41A 3/20 42/16
8,336,436 B2 * 12/2012 Kincel ..... F41A 3/72 42/16
8,356,537 B2 * 1/2013 Kincel ..... F41A 3/72 42/16
D738,452 S * 9/2015 Underwood ..... D22/108
9,222,738 B2 * 12/2015 Asher ..... F41A 3/72
D749,687 S * 2/2016 Warensford ..... D22/108
2011/0174139 A1 * 7/2011 Olsen ..... F41A 35/06 89/1.4
2013/0092014 A1 * 4/2013 Kincel ..... F41A 3/72 89/1.4
2014/0060293 A1 * 3/2014 Gomez ..... F41A 3/72 89/1.4
2014/0318356 A1 * 10/2014 Cupps ..... F41A 3/72 89/1.4

* cited by examiner

*Primary Examiner* — Benjamin P Lee
(74) *Attorney, Agent, or Firm* — Shaddock Law Group, PC

(57) ABSTRACT

A charging handle having a charging handle body having at least one handle recess formed within the charging handle body; a lever element having at least one lever recess formed in a portion of the lever element, wherein at least a portion of the lever element is slidable within at least a portion of the handle recess; and a latch element having a latch protrusion extending from at least a portion of the latch element, wherein the latch protrusion is formed so as to interact with at least a portion of the lever recess such that movement of the lever element relative to a longitudinal axis of the charging handle produces lateral translational movement of the latch element relative to the charging handle body.

20 Claims, 28 Drawing Sheets

CHARGING HANDLE FOR A FIREARM

CROSS-REFERENCE TO RELATED APPLICATIONS

This patent application is a Continuation of co-pending U.S. patent application Ser. No. 15/001,000, filed Jan. 19, 2016, now U.S. Pat. No. 9,587,896, which claims the benefit of U.S. Patent Application Ser. No. 62/105,274, filed Jan. 20, 2015, the disclosures of which are incorporated herein in their entireties by reference.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISC APPENDIX

Not Applicable.

NOTICE OF COPYRIGHTED MATERIAL

The disclosure of this patent document contains material that is subject to copyright protection. The copyright owner has no objection to the reproduction by anyone of the patent document or the patent disclosure, as it appears in the Patent and Trademark Office patent file or records, but otherwise reserves all copyright rights whatsoever. Unless otherwise noted, all trademarks and service marks identified herein are owned by the applicant.

BACKGROUND OF THE INVENTION

1. Field of the Invention

The present disclosure relates generally to the field of firearms. More specifically, the present disclosure relates to an ambidextrous charging handle adaptable to be used with a firearm, such as the AR-15, M4, and the like.

2. Description of Related Art

The AR-15 is based on the AR-10, which was designed by Eugene Stoner, Robert Fremont, and L. James Sullivan of the Fairchild ArmaLite Corporation in 1957. Today, there are numerous variants of the AR-15 that are manufactured by a number of companies. The AR-15 and its various related derivative platforms are used by civilians, law enforcement personnel, and military forces around the world.

Various firearms, such as, for example, the AR-15 or M-4 style firearms utilize a charging handle, located at top and substantially parallel to the bolt of the firearm, to manipulate the bolt and open the firearm's action and/or manually load a cartridge into the firearm's chamber.

The typical charging handle comprises an elongate portion of material that extends from a substantially T-shaped rear handle to a forward end adapted to engage the firearms bolt.

A spring-loaded, pivoting latch includes a hook or claw that engages a recess in the upper receiver of the firearm, to maintain the charging handle in a closed position relative to the upper receiver of the firearm. The pivoting latch is typically located on the left side of the charging handle and when the spring bias of the pivoting latch is overcome, by a user pulling reward on the left side of the charging handle, engaging the pivoting latch, the latch pivots to an unlocked position and allows the user to pull the charging handle rearward to manipulate the bolt.

Any discussion of documents, acts, materials, devices, articles, or the like, which has been included in the present specification is not to be taken as an admission that any or all of these matters form part of the prior art base or were common general knowledge in the field relevant to the present disclosure as it existed before the priority date of each claim of this application.

BRIEF SUMMARY OF THE INVENTION

Initially, the latch could only be manipulated from the left side of the firearm. Over time, modify charging handles have been developed that include an ambidextrous latch mechanism that allows the latch to be manipulated using a lever located on the right and/or left side of the charging handle. However, known ambidextrous charging handles utilize multiple pivot pins and a pivot at multiple points. Additionally, known ambidextrous charging handles typically include a combined latch and lever, wherein the latch (including the hook or claw) is an integral component of at least one of the levers. This results in an overly complicated design, which is prone to failure at multiple points.

The disadvantages and shortcomings of the prior art are overcome by the features and elements of the ambidextrous charging handle of the present disclosure. The advantages of the present disclosure are preferably attained by providing, in a first, exemplary, nonlimiting embodiment, an ambidextrous charging handle that comprises a charging handle body, a lever element, a latch element, and a spring biasing element.

The charging handle body comprises an elongate portion of material that extends along a longitudinal axis from a substantially T-shaped rear handle to a forward end having a bolt engagement element. The T-shaped rear handle includes a right handle portion and a left handle portion and a handle recess formed so as to slidably receive at least a portion of a lever element. The handle recess includes a slide pin or slide protrusion extending from a bottom wall of the handle recess.

The lever element comprises an elongate portion of material that includes a lever recess formed in a forward portion of the lever element. In various exemplary embodiments, the lever recess is formed at an obtuse angle, $\theta$, relative to a longitudinal axis of the lever element. An elongate lever channel is formed through a portion of the lever element from a top side to a bottom side, perpendicular to the longitudinal axis of the lever element. The lever channel is shaped so as to interact with the slide pin or slide protrusion to enable the lever element to be slidable forward and rearward, relative to the longitudinal axis of the charging handle, within the handle recess.

The latch element extends from a first portion to a second portion and a claw (including a ramp surface and shoulder) is formed proximate the first portion of the latch element. A latch protrusion is formed proximate the second portion of the latch element. The latch protrusion is formed so as to interact with the lever recess such that movement of the lever element along the longitudinal axis of the charging handle produces lateral (side-to-side), non-pivoting, movement of the latch element relative to the longitudinal axis of the charging handle.

The spring biasing element interacts between an interior side wall of the charging handle body and the lever element to bias the lever element in a forward or locked position. As the lever element is urged rearward, from either the right handle portion or the left handle portion of the charging handle body, the spring bias of the spring biasing element can be overcome to move the latch element from the locked to unlocked position.

In an exemplary, nonlimiting embodiment, the ambidextrous charging handle comprises a charging handle body, a latch element, a first lever element, a second lever element, and a spring biasing element.

The charging handle body comprises an elongate portion of material that extends along a longitudinal axis from a rear handle portion to a forward end having a bolt engagement element. The rear handle portion includes a handle recess formed so as to pivotably receive at least a portion of the latch element, the first lever element, the second lever element, and the spring biasing element. The handle recess includes a slide pin or slide protrusion extending from a bottom wall of the handle recess. Additionally, a camming element extends from the bottom wall of the handle recess.

The latch element extends from a first portion to a second portion and a claw (including a ramp surface and shoulder) is formed proximate the first portion of the latch element. A primary latch protrusion is formed proximate the second portion of the latch element, in a top portion of the latch element, while a secondary latch protrusion is formed proximate the second portion of the latch element, in a bottom portion of the latch element.

The first lever element comprises an elongate portion of material that extends from a latch engagement portion to a finger engagement portion. A slide pin aperture is formed through the latch engagement portion, such that when the slide pin aperture interacts with the slide protrusion, the first lever element is able to be pivoted from a locked position to an unlocked position. The first lever element includes a curved, camming surface formed so as to interact with a secondary latch protrusion of the latch element. A spring engagement protrusion extends from a portion of the first lever element so as to engage and interact with the spring biasing element.

The second lever element comprises an elongate portion of material that also extends from a latch engagement portion to a finger engagement portion. A slide pin aperture is formed through the latch engagement portion, such that when the slide pin aperture interacts with the slide protrusion, the second lever element is able to be pivoted from a locked position to an unlocked position. The second lever element includes a lever recess formed so as to interact with a primary latch protrusion of the latch element. A spring engagement protrusion extends from a portion of the second lever element so as to engage and interact with the spring biasing element.

The primary latch protrusion is formed so as to interact with the lever recess of the second lever element such that rotation of the second lever element about the slide protrusion produces lateral movement of the latch element relative to the longitudinal axis of the charging handle.

The secondary latch protrusion is formed so as to interact with the camming surface of the first lever element such that rotation of the first lever element about the slide protrusion also produces lateral movement of the latch element relative to the longitudinal axis of the charging handle. When the camming surface of the first lever element produces movement of the latch element (via interaction of the secondary latch protrusion and the camming surface), the primary latch protrusion interacts with the lever recess of the second lever element to produce rotational movement of the second lever element.

The spring biasing element interacts between the spring engagement protrusion of the first lever element and the spring engagement protrusion of the second lever element to bias the first lever element and the second lever element against one another in a forward or locked position. As the first lever element and/or the second lever element is urged rearward, the spring bias of the spring biasing element can be overcome to move the latch element from the locked to unlocked position.

Accordingly, the present disclosure separately provides an improved ambidextrous charging handle for firearms.

The present disclosure separately provides an improved ambidextrous charging handle for firearms having a simplified design.

The present disclosure separately provides an improved ambidextrous charging handle for firearms, which provides ambidextrous functions with a single slide pin or slide protrusion.

The present disclosure separately provides an improved ambidextrous charging handle for firearms having a latch element that moves from a locked to an unlocked position in a lateral or linear, nonrotating, fashion.

These and other aspects, features, and advantages of the present disclosure are described in or are apparent from the following detailed description of the exemplary, non-limiting embodiments of the present disclosure and the accompanying figures. Other aspects and features of embodiments of the present disclosure will become apparent to those of ordinary skill in the art upon reviewing the following description of specific, exemplary embodiments of the present disclosure in concert with the figures. While features of the present disclosure may be discussed relative to certain embodiments and figures, all embodiments of the present disclosure can include one or more of the features discussed herein. Further, while one or more embodiments may be discussed as having certain advantageous features, one or more of such features may also be used with the various embodiments of the disclosure discussed herein. In similar fashion, while exemplary embodiments may be discussed below as device, system, or method embodiments, it is to be understood that such exemplary embodiments can be implemented in various devices, systems, and methods of the present disclosure.

Any benefits, advantages, or solutions to problems that are described herein with regard to specific embodiments are not intended to be construed as a critical, required, or essential feature(s) or element(s) of the present disclosure or the claims.

BRIEF DESCRIPTION OF THE SEVERAL VIEWS OF THE DRAWINGS

As required, detailed exemplary embodiments of the present disclosure are disclosed herein; however, it is to be understood that the disclosed embodiments are merely exemplary of what may be embodied in various and alternative forms, within the scope of the present disclosure. The figures are not necessarily to scale; some features may be exaggerated or minimized to illustrate details of particular components. Therefore, specific structural and functional details disclosed herein are not to be interpreted as limiting, but merely as a basis for the claims and as a representative basis for teaching one skilled in the art to employ the present disclosure.

The exemplary embodiments of the present disclosure will be described in detail, with reference to the following figures, wherein like reference numerals refer to like parts throughout the several views, and wherein.

DETAILED DESCRIPTION OF THE INVENTION

For simplicity and clarification, the design factors and operating principles of the ambidextrous charging handle according to an exemplary embodiment of the present disclosure are explained with reference to various exemplary embodiments of an ambidextrous charging handle according to an exemplary embodiment of the present disclosure. The basic explanation of the design factors and operating principles of the ambidextrous charging handle is applicable for the understanding, design, and operation of the ambidextrous charging handle of the present disclosure. It should be appreciated that the ambidextrous charging handle can be adapted to many applications where an ambidextrous charging handle or strap can be used.

As used herein, the word "may" is meant to convey a permissive sense (i.e., meaning "having the potential to"), rather than a mandatory sense (i.e., meaning "must"). Unless stated otherwise, terms such as "first" and "second" are used to arbitrarily distinguish between the elements such terms describe. Thus, these terms are not necessarily intended to indicate temporal or other prioritization of such elements.

The term "coupled", as used herein, is defined as connected, although not necessarily directly, and not necessarily mechanically. The terms "a" and "an" are defined as one or more unless stated otherwise.

Throughout this application, the terms "comprise" (and any form of comprise, such as "comprises" and "comprising"), "have" (and any form of have, such as "has" and "having"), "include", (and any form of include, such as "includes" and "including") and "contain" (and any form of contain, such as "contains" and "containing") are used as open-ended linking verbs. It will be understood that these terms are meant to imply the inclusion of a stated element, integer, step, or group of elements, integers, or steps, but not the exclusion of any other element, integer, step, or group of elements, integers, or steps. As a result, a system, method, or apparatus that "comprises", "has", "includes", or "contains" one or more elements possesses those one or more elements but is not limited to possessing only those one or more elements. Similarly, a method or process that "comprises", "has", "includes" or "contains" one or more operations possesses those one or more operations but is not limited to possessing only those one or more operations.

It should also be appreciated that the terms "ambidextrous charging handle", "latch element", and "lever element" are used for basic explanation and understanding of the operation of the systems, methods, and apparatuses of the present disclosure. Therefore, the terms "ambidextrous charging handle", "latch element", and "lever element" are not to be construed as limiting the systems, methods, and apparatuses of the present disclosure.

Figure 33:
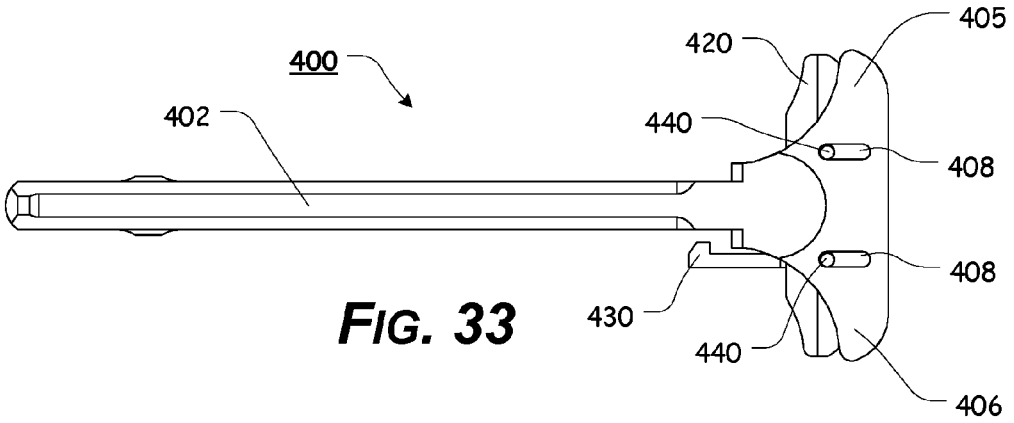
FIG. 33 illustrates a top view of an exemplary embodiment of an ambidextrous charging handle, wherein the latch element is in the locked position, according to an exemplary embodiment of the present disclosure.
Figure 34:
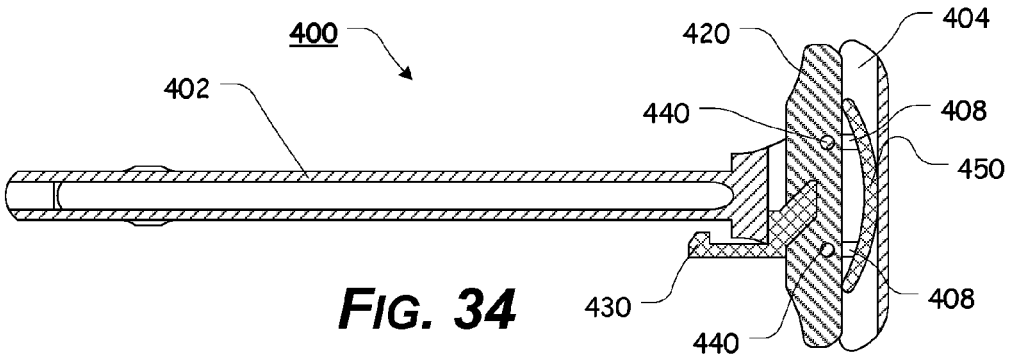
FIG. 34 illustrates a top, cross-sectional view of an exemplary embodiment of an ambidextrous charging handle, wherein the latch element is in the locked position, according to an exemplary embodiment of the present disclosure.
Figure 35:
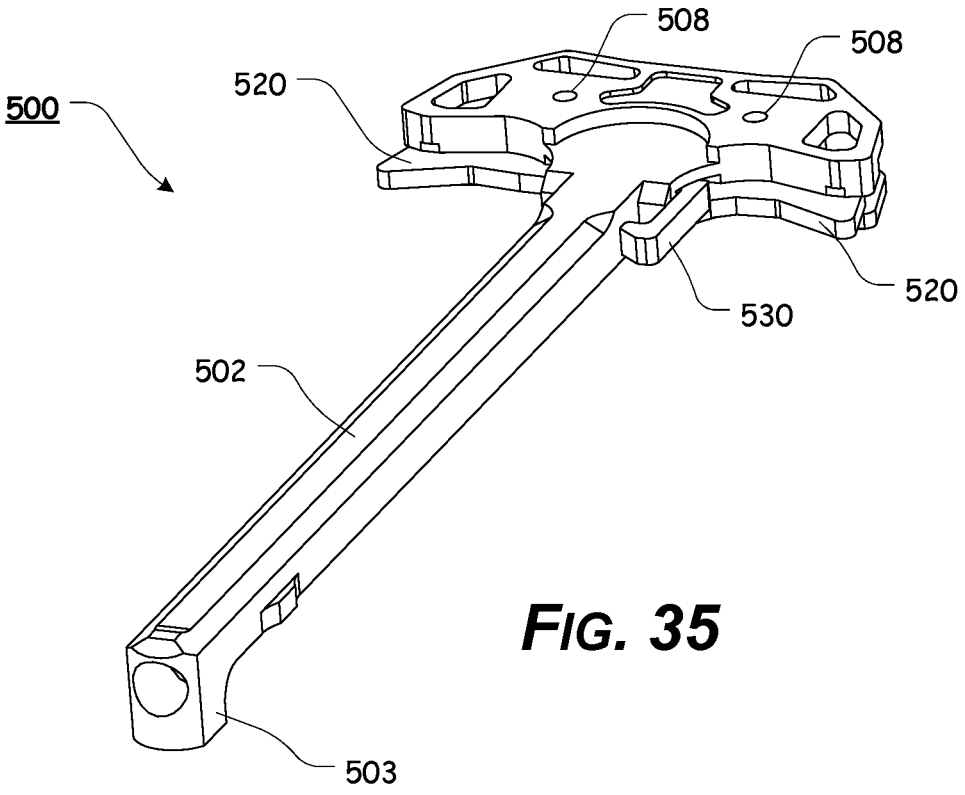
FIG. 35 illustrates a front perspective view of an exemplary embodiment of an ambidextrous charging handle, according to an exemplary embodiment of the present disclosure.
Figure 36:
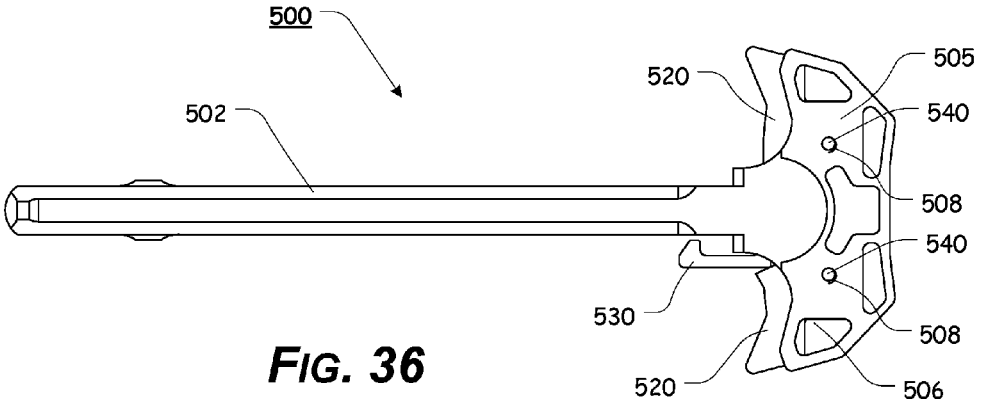
FIG. 36 illustrates a top view of an exemplary embodiment of an ambidextrous charging handle, according to an exemplary embodiment of the present disclosure.
Figure 37:
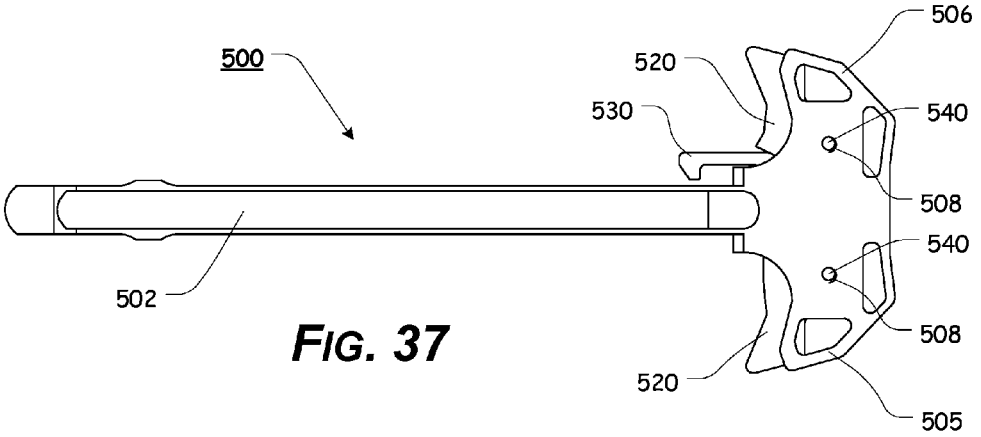
FIG. 37 illustrates a bottom view of an exemplary embodiment of an ambidextrous charging handle, according to an exemplary embodiment of the present disclosure.
Figure 38:
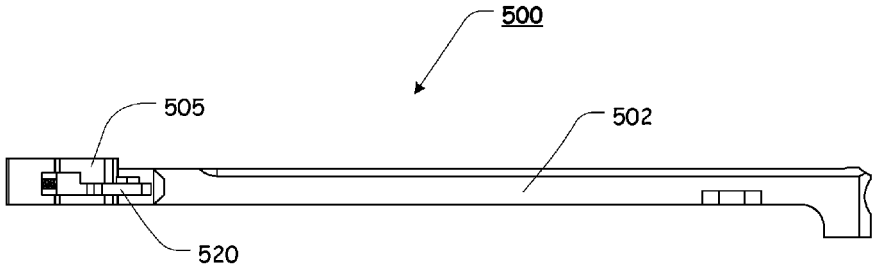
FIG. 38 illustrates a right side view of an exemplary embodiment of an ambidextrous charging handle, according to an exemplary embodiment of the present disclosure.
Figure 39:
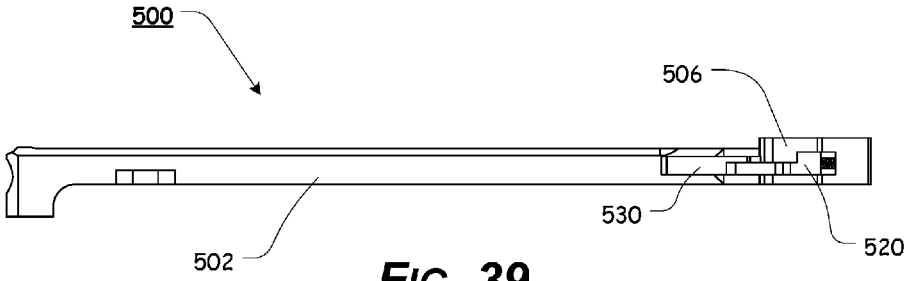
FIG. 39 illustrates a left side view of an exemplary embodiment of an ambidextrous charging handle, according to an exemplary embodiment of the present disclosure.
Figure 40:
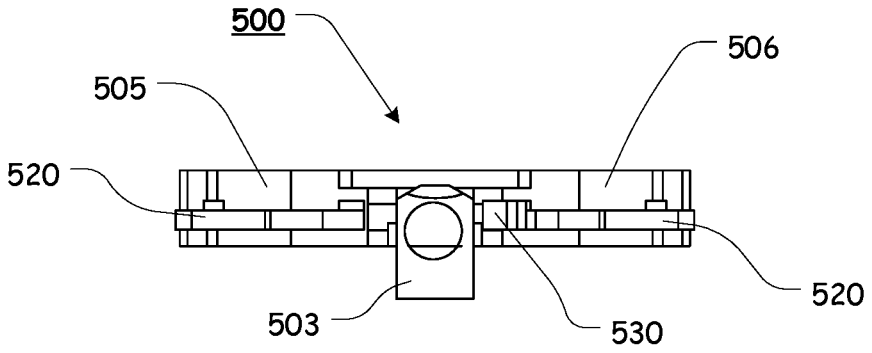
FIG. 40 illustrates a front view of an exemplary embodiment of an ambidextrous charging handle, according to an exemplary embodiment of the present disclosure.
Figure 41:
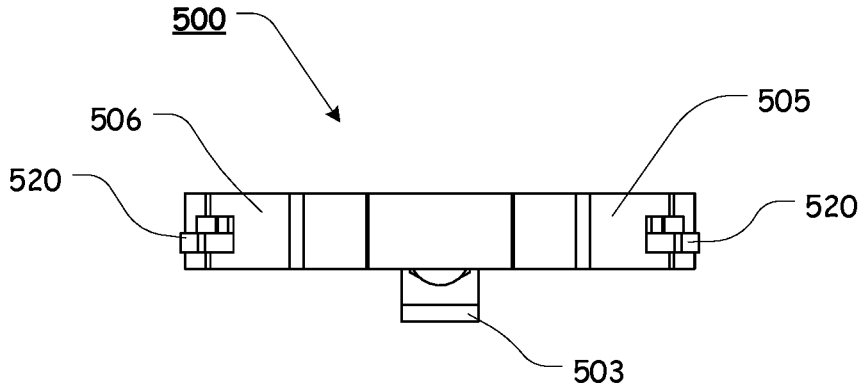
FIG. 41 illustrates a rear view of an exemplary embodiment of an ambidextrous charging handle, according to an exemplary embodiment of the present disclosure.
Figure 42:
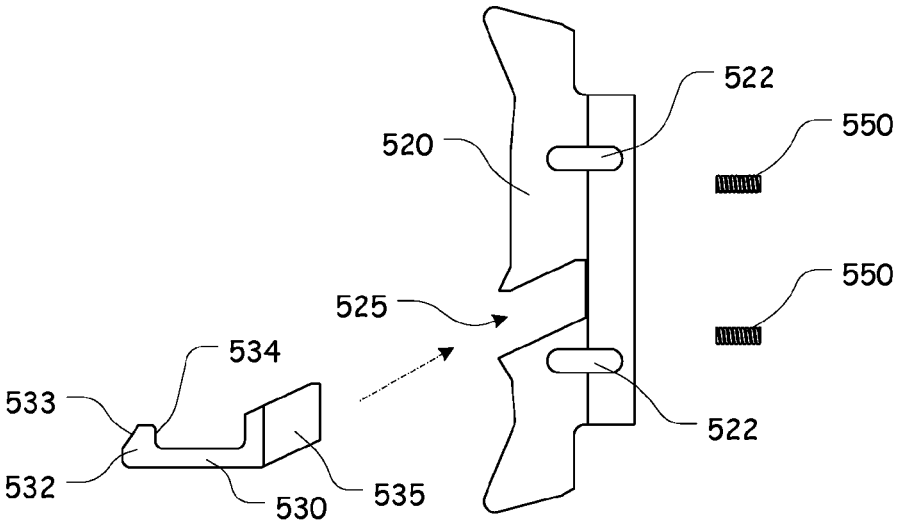
FIG. 42 illustrates a top view of an exemplary embodiment of the lever element, the latch element, and the spring biasing element of an ambidextrous charging handle, according to an exemplary embodiment of the present disclosure.
Figure 43:
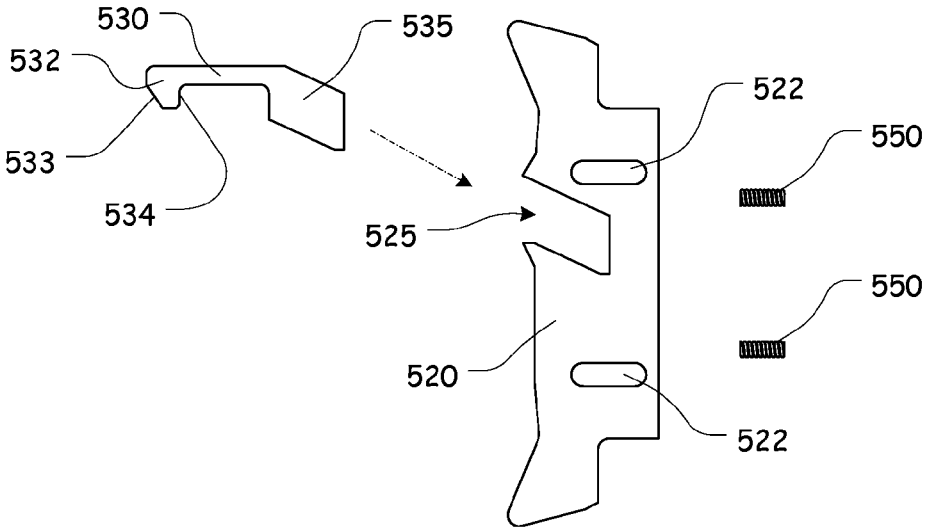
FIG. 43 illustrates a bottom view of an exemplary embodiment of the lever element, the latch element, and the spring biasing element of an ambidextrous charging handle, according to an exemplary embodiment of the present disclosure.
Figure 44:
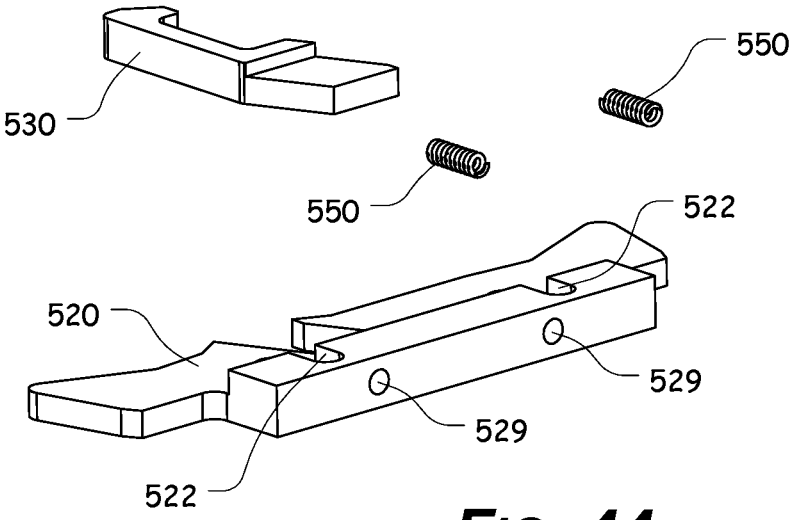
FIG. 44 illustrates an exploded, perspective view of an exemplary embodiment of the lever element, the latch element, and the spring biasing element of an ambidextrous charging handle, according to an exemplary embodiment of the present disclosure.
Figure 45:
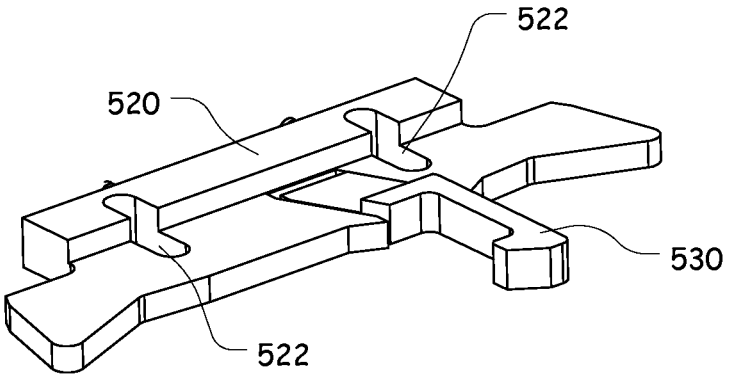
FIG. 45 illustrates an upper, front, perspective view of an exemplary embodiment of the lever element, the latch element, and the spring biasing element of an ambidextrous charging handle, according to an exemplary embodiment of the present disclosure.
Figure 46:
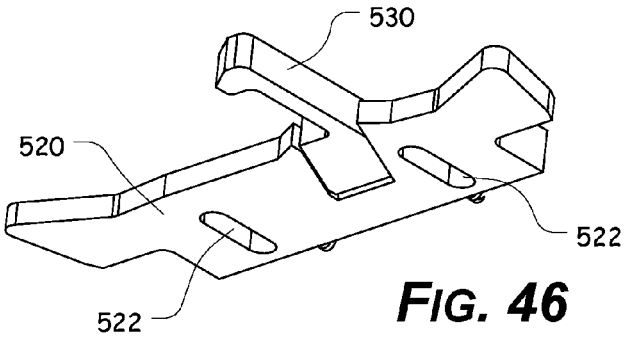
FIG. 46 illustrates a left side, lower, perspective view of an exemplary embodiment of the lever element, the latch element, and the spring biasing element of an ambidextrous charging handle, according to an exemplary embodiment of the present disclosure.
Figure 47:
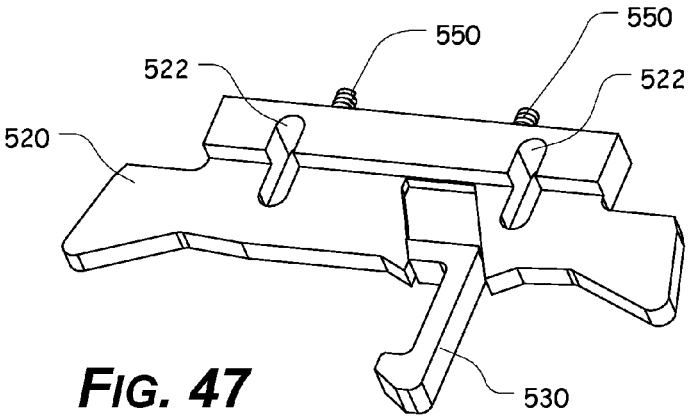
FIG. 47 illustrates a upper, front, perspective view of an exemplary embodiment of the lever element, the latch element, and the spring biasing element of an ambidextrous charging handle, according to an exemplary embodiment of the present disclosure.
Figure 48:
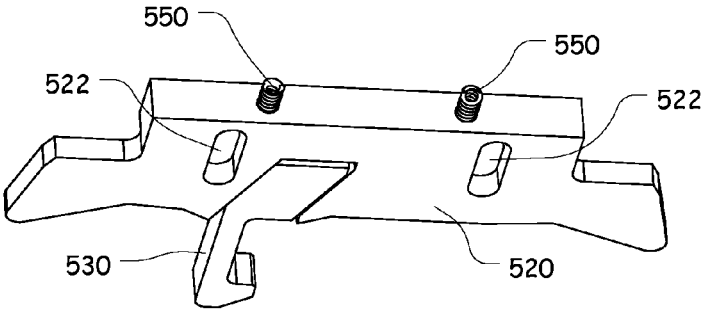
FIG. 48 illustrates a lower, rear, perspective view of an exemplary embodiment of the lever element, the latch element, and the spring biasing element of an ambidextrous charging handle, according to an exemplary embodiment of the present disclosure.
Figure 49:
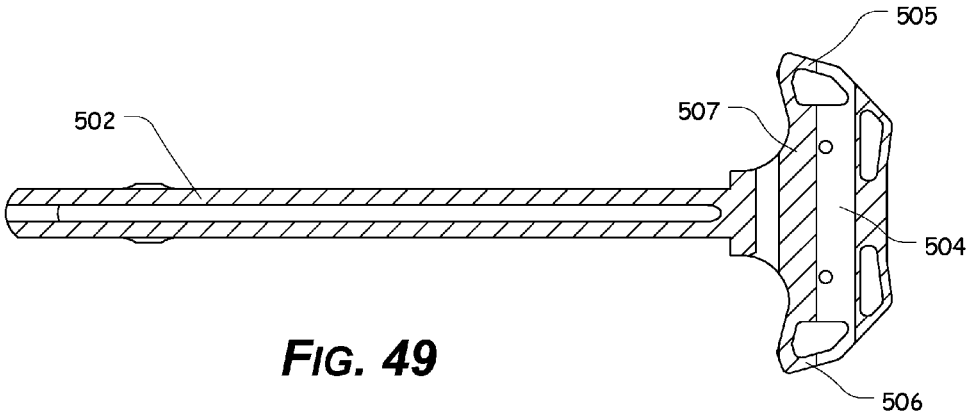
FIG. 49 illustrates a top, cross-sectional view of an exemplary embodiment of the charging handle body, according to an exemplary embodiment of the present disclosure.

Turning now to the drawing FIGS., FIGS. 1-24 illustrate various elements and/or aspects of an exemplary embodiment of the ambidextrous charging handle 100, according to this disclosure. FIGS. 25-28 illustrate various elements and/or aspects of an exemplary embodiment of the ambidextrous charging handle 200, FIGS. 29-32 illustrate various elements and/or aspects of an exemplary embodiment of the ambidextrous charging handle 300, FIGS. 33-34 illustrate various elements and/or aspects of an exemplary embodiment of the ambidextrous charging handle 400, and FIGS. 35-46 illustrate various elements and/or aspects of an exemplary embodiment of the ambidextrous charging handle 500, according to this disclosure.

As illustrated in FIGS. 1-24, the exemplary embodiment of the ambidextrous charging handle 100 of the present disclosure comprises a charging handle body 102, a lever element 120, a latch element 130, and a spring biasing element 150.

The charging handle body 102 comprises an elongate portion of material that extends along a longitudinal axis from a substantially T-shaped rear handle to a forward end having a bolt engagement element 103. The T-shaped rear handle includes a right handle portion 105 and a left handle portion 106. A handle recess 104 is formed within the T-shaped rear handle portion and is shaped so as to slidably receive at least a portion of the lever element 120 inside the handle recess 104.

A slide protrusion or slide pin 140 extends from a bottom wall of the handle recess 104. In certain exemplary embodiments, the slide protrusion or slide pin 140 extends from both the bottom wall and a top wall of the handle recess 104. Alternatively, a slide pin aperture 108 may be formed through the charging handle body 102 and the slide protrusion or slide pin 140 may comprise a slide pin 140 positioned within the slide pin aperture 108.

In various exemplary embodiments, the lever element 120 comprises an elongate portion of material that includes a lever recess 125 formed in a forward portion of the lever element 120. In various exemplary embodiments, the lever recess 125 is formed at an obtuse angle, e, relative to a longitudinal axis of the lever element 120.

An elongate lever channel 122 is formed through a portion of the lever element 120 from a top side to a bottom side, perpendicular to the longitudinal axis of the lever element 120. The lever channel 122 is shaped so as to interact with the slide protrusion or slide pin 140 to enable the lever element 120 to be slidable forward and/or rearward, relative to the longitudinal axis of the charging handle 100, within the handle recess 104.

In various exemplary embodiments, slide support surfaces 107 are formed within the handle recess 104 so as to provide support or sliding surfaces for the lever element 120.

The latch element 130 extends from a first portion to a second portion and a claw 132 (including a ramp surface 133 and shoulder 134) is formed proximate the first portion of the latch element 130. A latch protrusion 135 is formed proximate the second portion of the latch element 130. The latch protrusion 135 is formed so as to be at least partially received within and interact with the lever recess 125 such that movement of the lever element 120 along the longitudinal axis of the charging handle 100 (forward and backward) produces lateral (side-to-side), non-pivoting, movement of the latch element 130 relative to the longitudinal axis of the charging handle 100.

Figure 1:
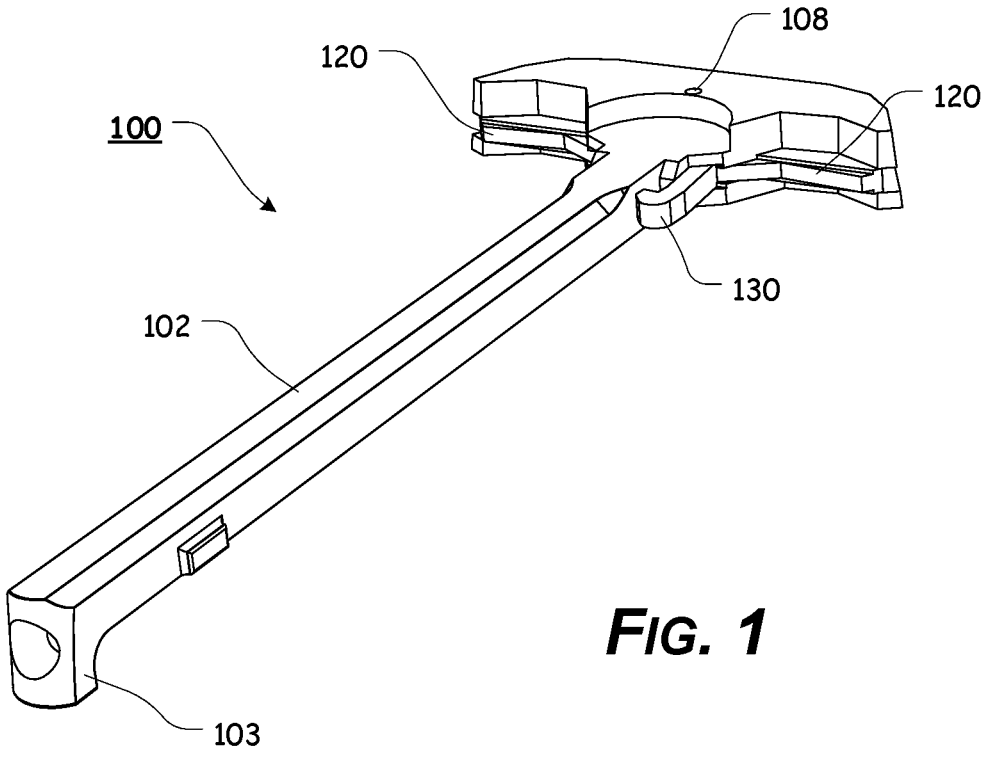
FIG. 1 illustrates a front perspective view of an exemplary embodiment of an ambidextrous charging handle, according to an exemplary embodiment of the present disclosure.
Figure 2:
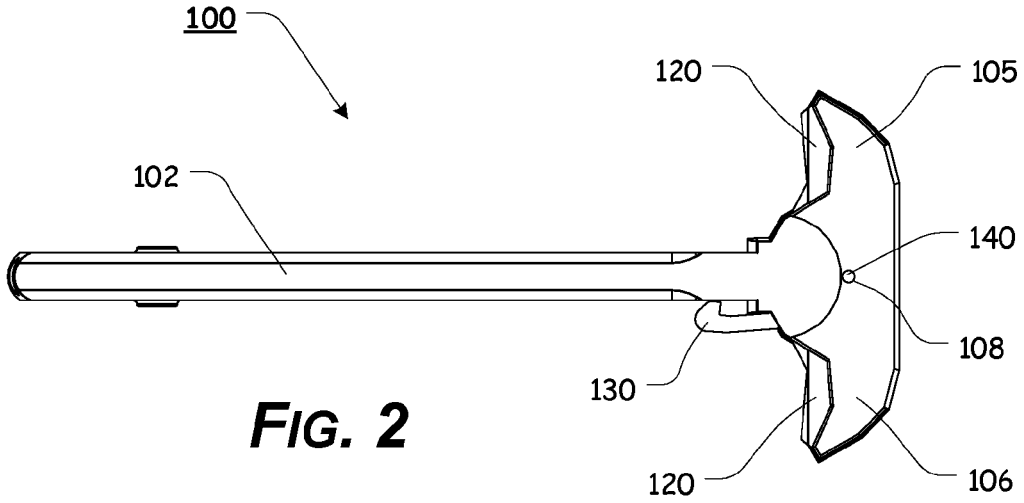
FIG. 2 illustrates a top view of an exemplary embodiment of an ambidextrous charging handle, according to an exemplary embodiment of the present disclosure.
Figure 3:
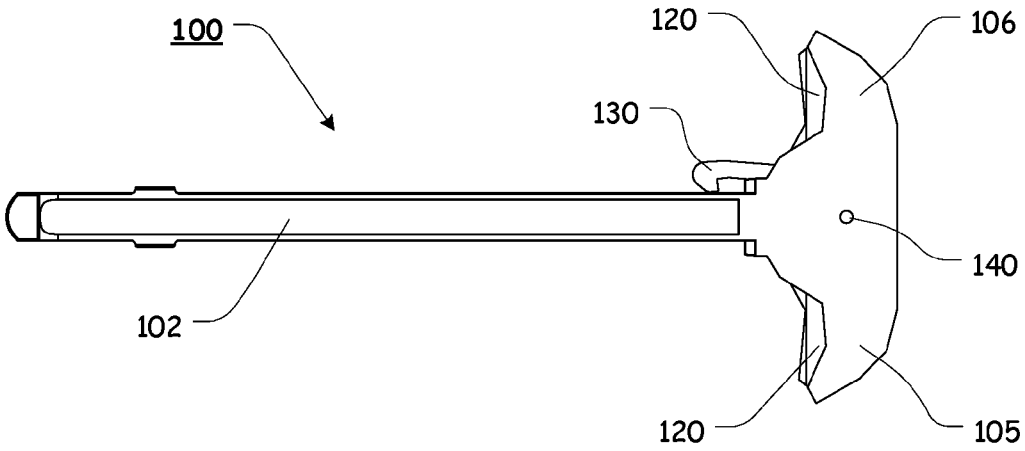
FIG. 3 illustrates a bottom view of an exemplary embodiment of an ambidextrous charging handle, according to an exemplary embodiment of the present disclosure.
Figure 4:
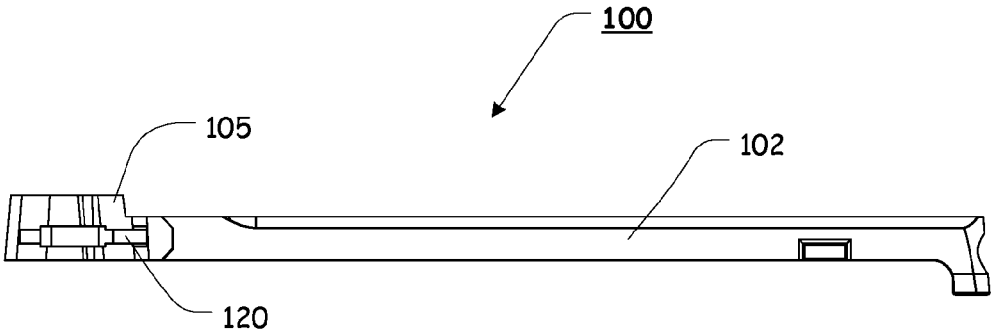
FIG. 4 illustrates a right side view of an exemplary embodiment of an ambidextrous charging handle, according to an exemplary embodiment of the present disclosure.
Figure 5:
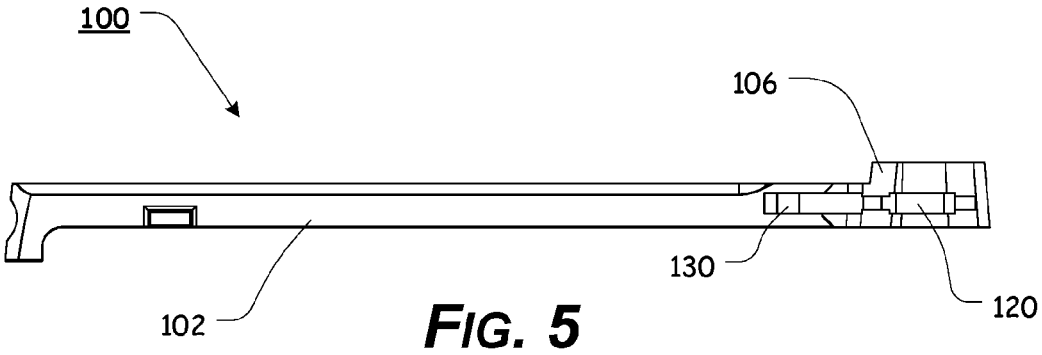
FIG. 5 illustrates a left side view of an exemplary embodiment of an ambidextrous charging handle, according to an exemplary embodiment of the present disclosure.
Figure 6:
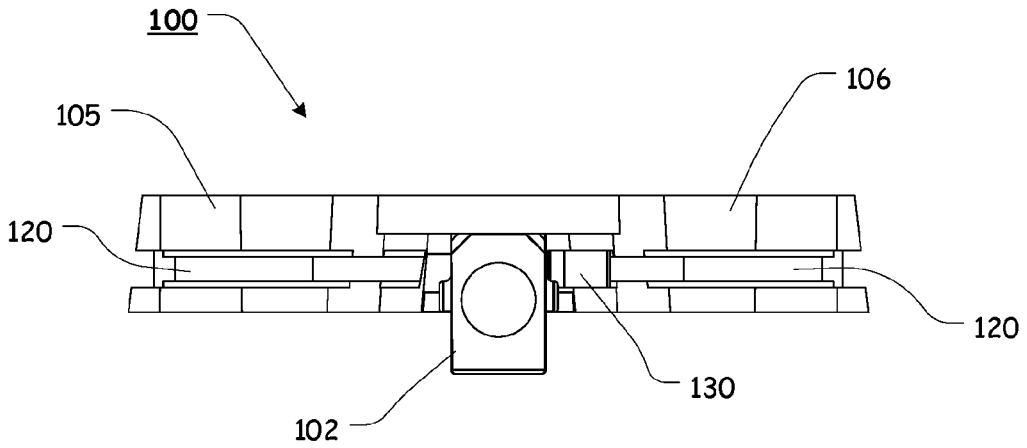
FIG. 6 illustrates a front view of an exemplary embodiment of an ambidextrous charging handle, according to an exemplary embodiment of the present disclosure.
Figure 7:
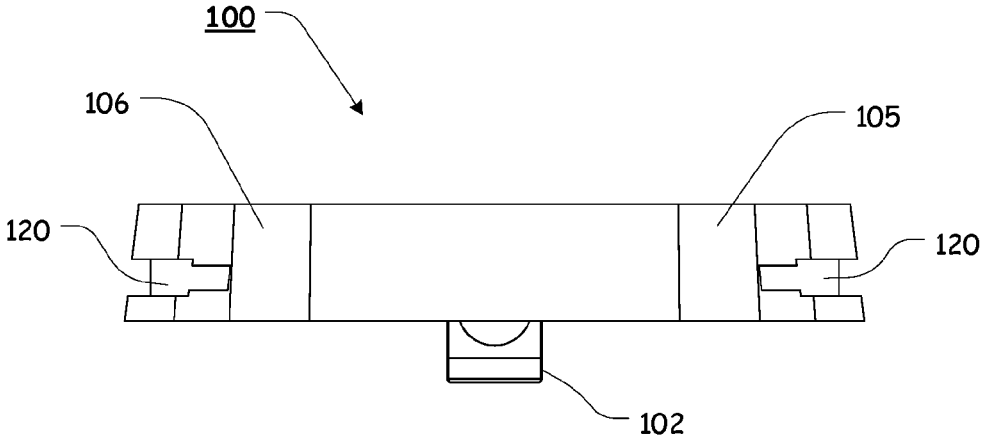
FIG. 7 illustrates a rear view of an exemplary embodiment of an ambidextrous charging handle, according to an exemplary embodiment of the present disclosure.
Figure 8:
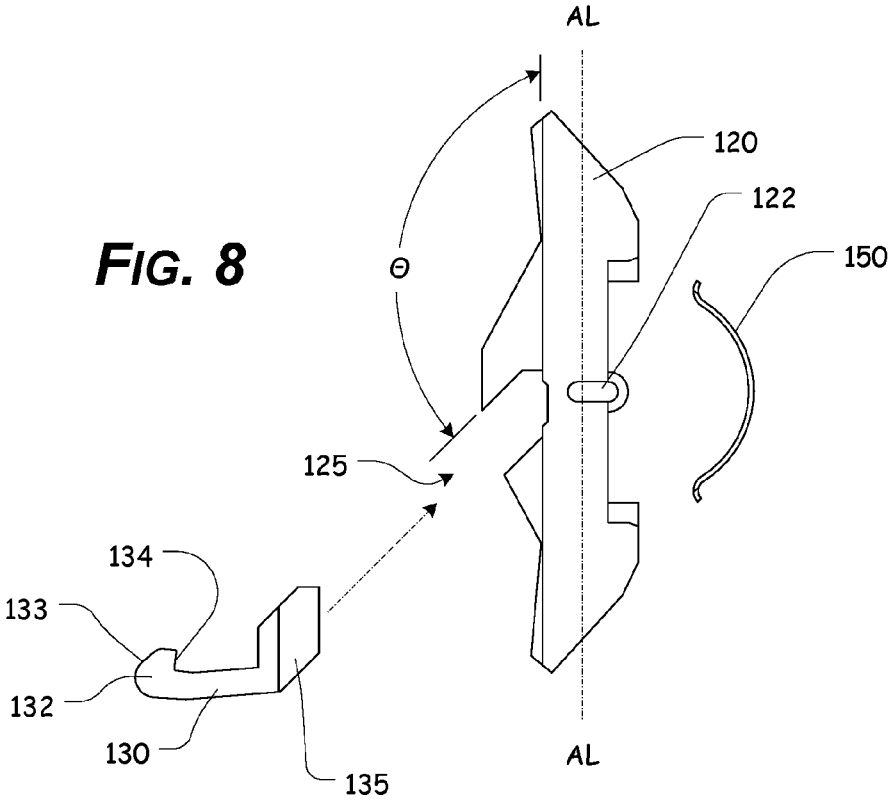
FIG. 8 illustrates a top view of an exemplary embodiment of the lever element, the latch element, and the spring biasing element of an ambidextrous charging handle, according to an exemplary embodiment of the present disclosure.
Figure 9:
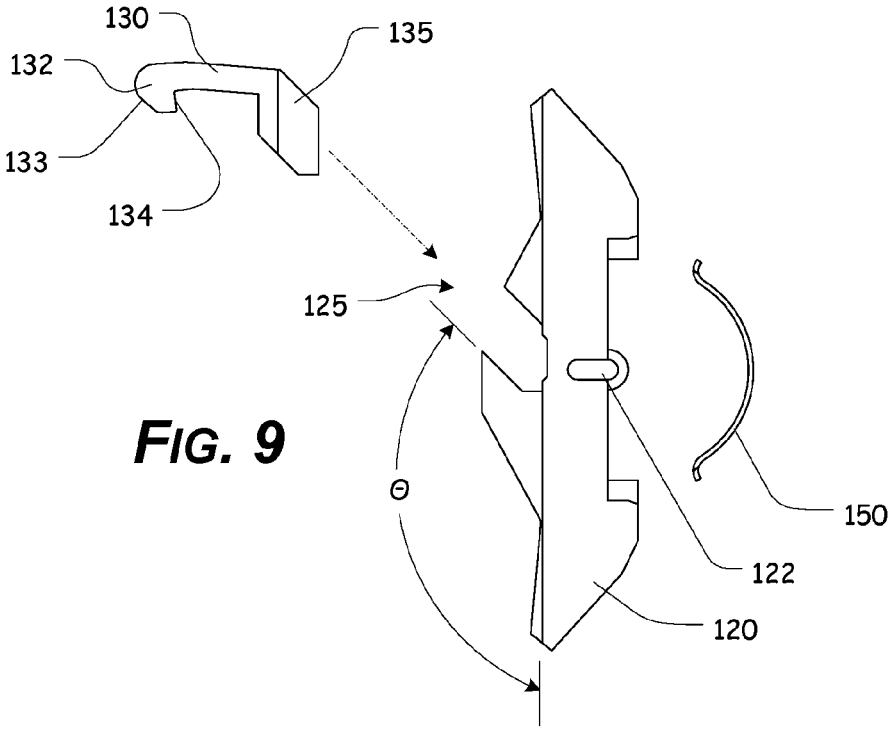
FIG. 9 illustrates a bottom view of an exemplary embodiment of the lever element, the latch element, and the spring biasing element of an ambidextrous charging handle, according to an exemplary embodiment of the present disclosure.
Figure 10:
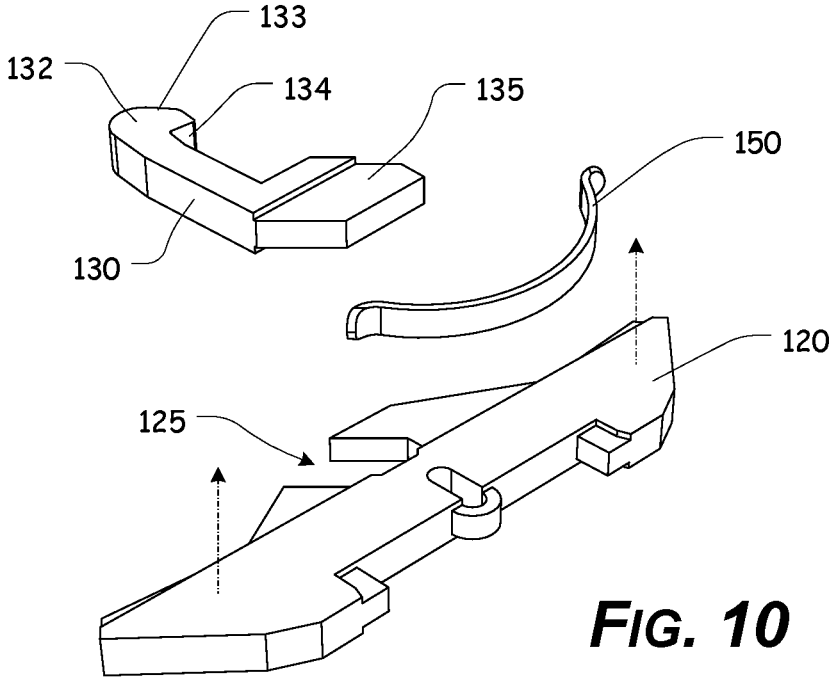
FIG. 10 illustrates an exploded, perspective view of an exemplary embodiment of the lever element, the latch element, and the spring biasing element of an ambidextrous charging handle, according to an exemplary embodiment of the present disclosure.
Figure 11:
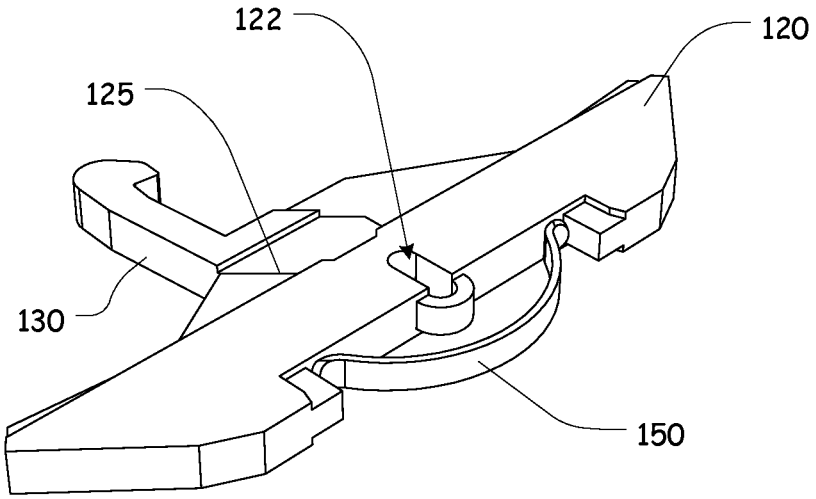
FIG. 11 illustrates an upper, rear, perspective view of an exemplary embodiment of the lever element, the latch element, and the spring biasing element of an ambidextrous charging handle, according to an exemplary embodiment of the present disclosure.
Figure 12:
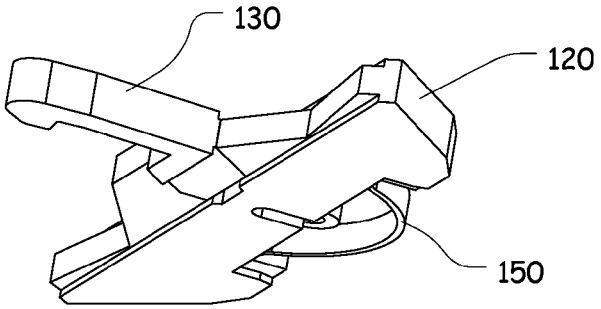
FIG. 12 illustrates a left side, lower, perspective view of an exemplary embodiment of the lever element, the latch element, and the spring biasing element of an ambidextrous charging handle, according to an exemplary embodiment of the present disclosure.
Figure 13:
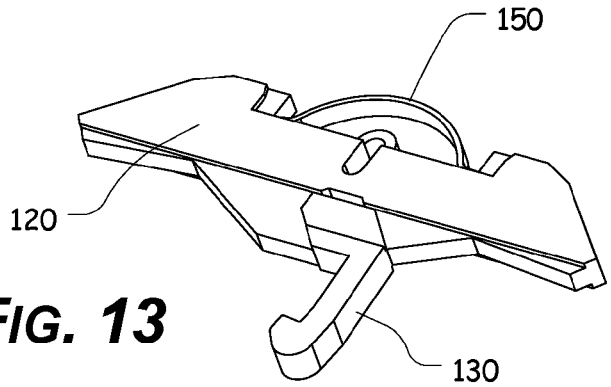
FIG. 13 illustrates a upper, front, perspective view of an exemplary embodiment of the lever element, the latch element, and the spring biasing element of an ambidextrous charging handle, according to an exemplary embodiment of the present disclosure.
Figure 14:
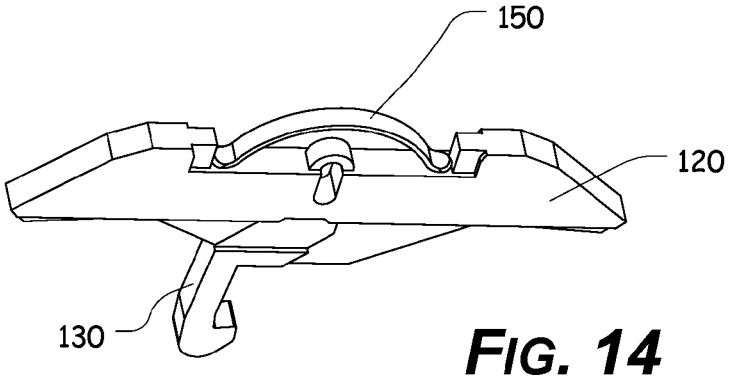
FIG. 14 illustrates a lower, rear, perspective view of an exemplary embodiment of the lever element, the latch element, and the spring biasing element of an ambidextrous charging handle, according to an exemplary embodiment of the present disclosure.
Figure 15:
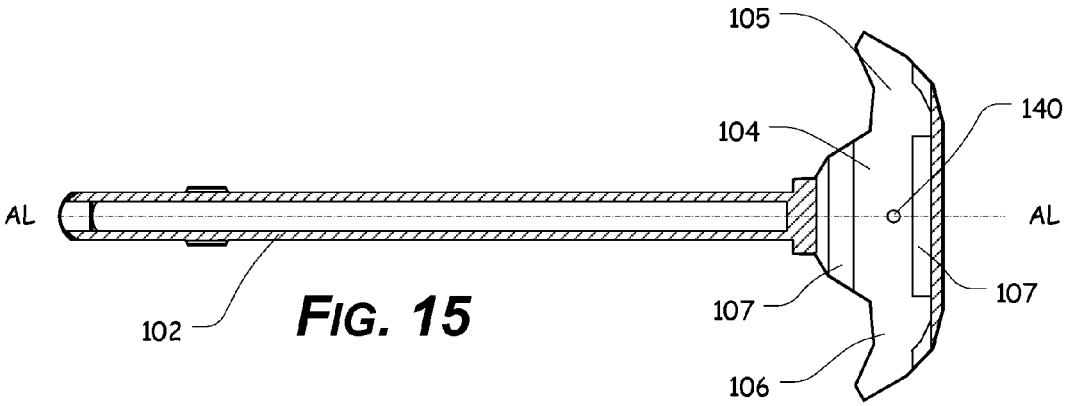
FIG. 15 illustrates a top, cross-sectional view of an exemplary embodiment of the charging handle body, according to an exemplary embodiment of the present disclosure.
Figure 16:
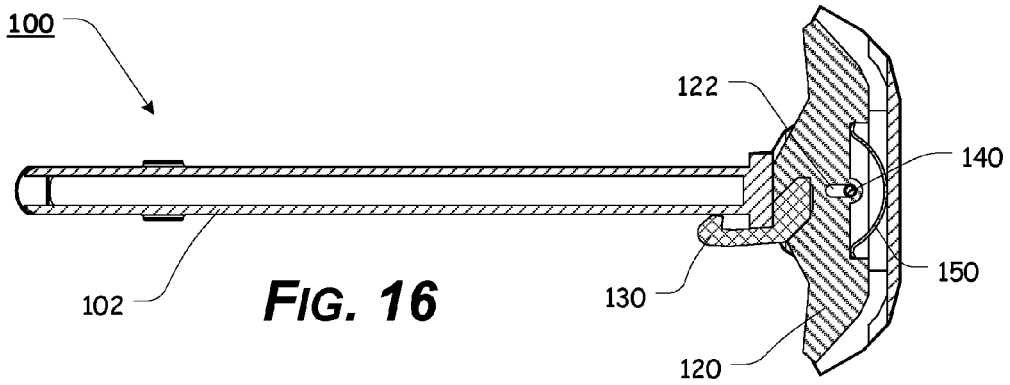
FIG. 16 illustrates a top, cross-sectional view showing various components of an exemplary embodiment of an ambidextrous charging handle, wherein the latch element is in the locked position, according to an exemplary embodiment of the present disclosure.
Figure 17:
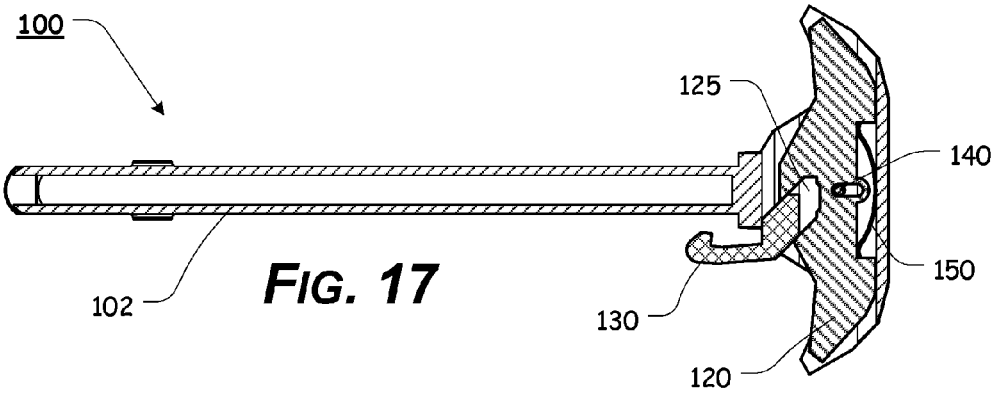
FIG. 17 illustrates a top, cross-sectional view showing various components of an exemplary embodiment of an ambidextrous charging handle, wherein the latch element is in the unlocked position, according to an exemplary embodiment of the present disclosure.
Figure 18:
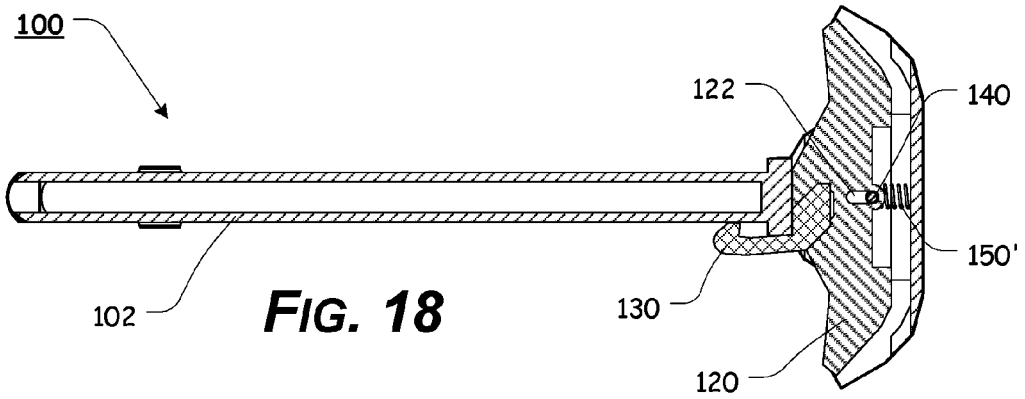
FIG. 18 illustrates a top, cross-sectional view showing various components of an exemplary embodiment of an ambidextrous charging handle, wherein the latch element is in the locked position, according to an exemplary embodiment of the present disclosure.
Figure 19:
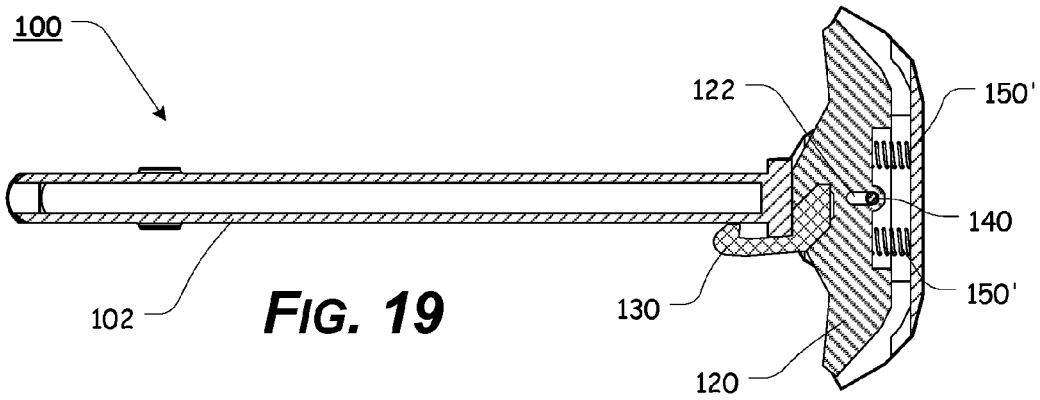
FIG. 19 illustrates a top, cross-sectional view showing various components of an exemplary embodiment of an ambidextrous charging handle, wherein the latch element is in the locked position, according to an exemplary embodiment of the present disclosure.

Because of the relative angles of the interior sidewalls of the lever recess 125 and the exterior sidewalls of the latch protrusion 135, as the lever element 120 is urged from the locked position, as illustrated in FIG. 16, to the unlocked position, as illustrated in FIG. 17, the rearward movement of the lever element 120 (and the lever recess 125) causes one or more of the sidewalls of the lever recess 125 to contact one or more of the sidewalls of the latch protrusion 135 and urged the latch protrusion 135 (and the latch element 130) to move laterally, away from the charging handle body 102.

If included, the spring biasing element 150 interacts between an interior side wall of the charging handle body 102 and the lever element 120 to bias the lever element 120 in a forward or locked position. As the lever element 120 is urged rearward, from either the right handle portion 105 or the left handle portion 106 of the charging handle body 102, the spring bias of the spring biasing element 150 can be overcome to move the latch element 130 from the locked to unlocked position.

In various exemplary embodiments, a spring biasing element 150 comprises a curved portion of spring steel. In certain other exemplary, nonlimiting embodiments, the spring biasing element 150' comprises one or more compression springs. It should also be understood that the spring biasing element 150 and/or 150' may optionally comprise a spring, a resilient portion of material, or other element capable of providing a biasing force to the lever element 120.

Figure 20:
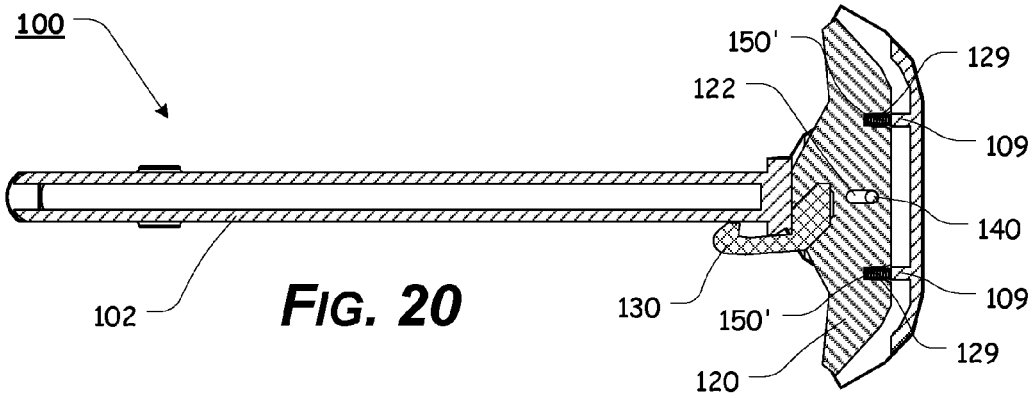
FIG. 20 illustrates a top, cross-sectional view showing various components of an exemplary embodiment of an ambidextrous charging handle, wherein the latch element is in the locked position, according to an exemplary embodiment of the present disclosure.

In various exemplary, nonlimiting embodiments, as illustrated in FIG. 20, one or more alignment protrusions 109 extend within various portions of the handle recess 104 and correspond to mating alignment recesses 129 formed in the lever element 120. If included, the one or more alignment protrusions 109 are aligned with or within the alignment recesses 129 during movement of the lever element 120 along the longitudinal axis of the charging handle 100. It should also be appreciated that the protrusions may extend from the lever element 120 and interact with mating recesses formed in the handle recess 104.

In various exemplary embodiments, a spring biasing element 150 or 150' is positioned within each of the mating alignment recess 129 to provide spring biasing to the lever element 120.

Figure 21:
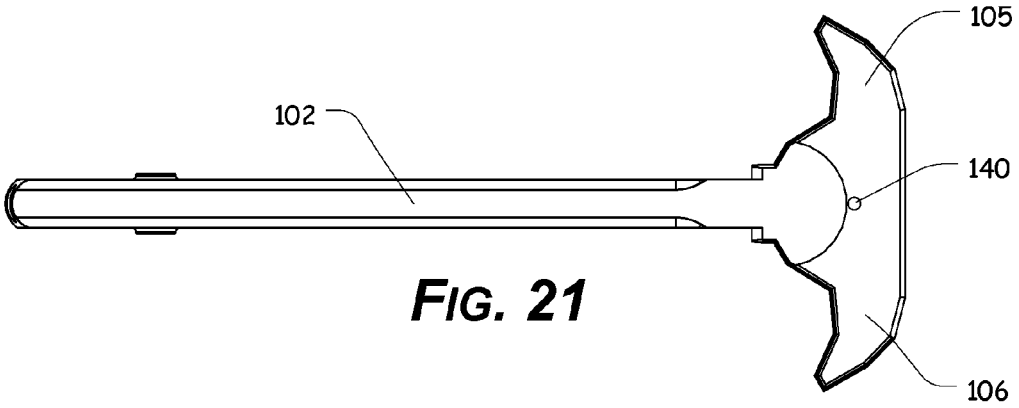
FIG. 21 illustrates a top view of an exemplary embodiment of an ambidextrous charging handle body, wherein the latch element is in the locked position, according to an exemplary embodiment of the present disclosure.
Figure 22:
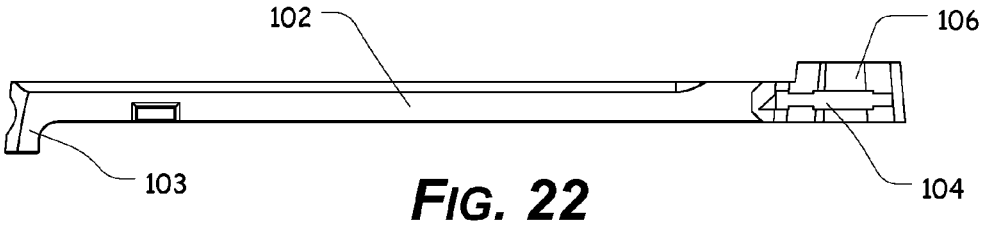
FIG. 22 illustrates a side view of an exemplary embodiment of an ambidextrous charging handle body, wherein the latch element is in the locked position, according to an exemplary embodiment of the present disclosure.
Figure 23:
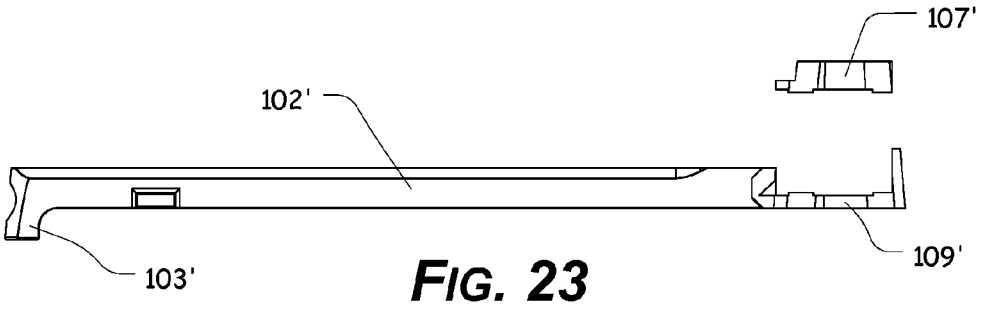
FIG. 23 illustrates a side view of an exemplary embodiment of an ambidextrous charging handle body, wherein the latch element is in the locked position, according to an exemplary embodiment of the present disclosure.
Figure 24:
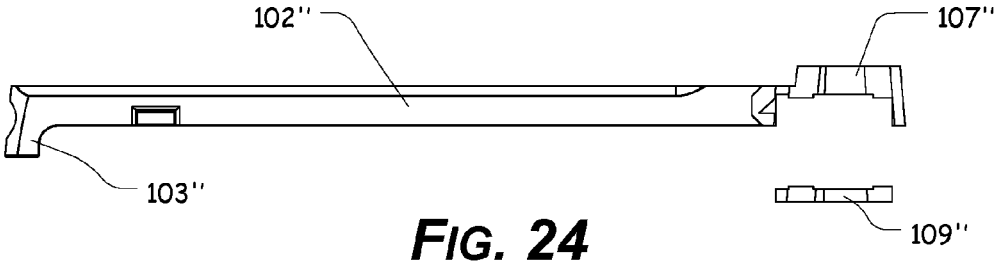
FIG. 24 illustrates a side view of an exemplary embodiment of an ambidextrous charging handle body, wherein the latch element is in the locked position, according to an exemplary embodiment of the present disclosure.
Figure 25:
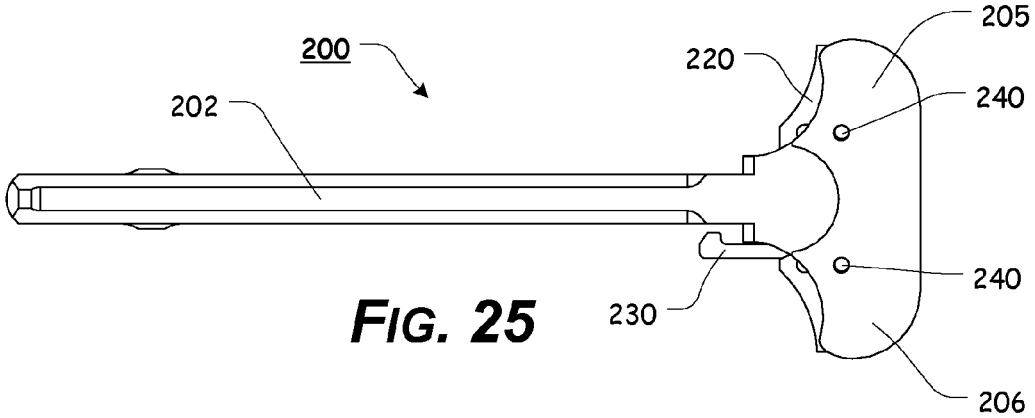
FIG. 25 illustrates a top view of an exemplary embodiment of an ambidextrous charging handle, wherein the latch element is in the locked position, according to an exemplary embodiment of the present disclosure.
Figure 26:
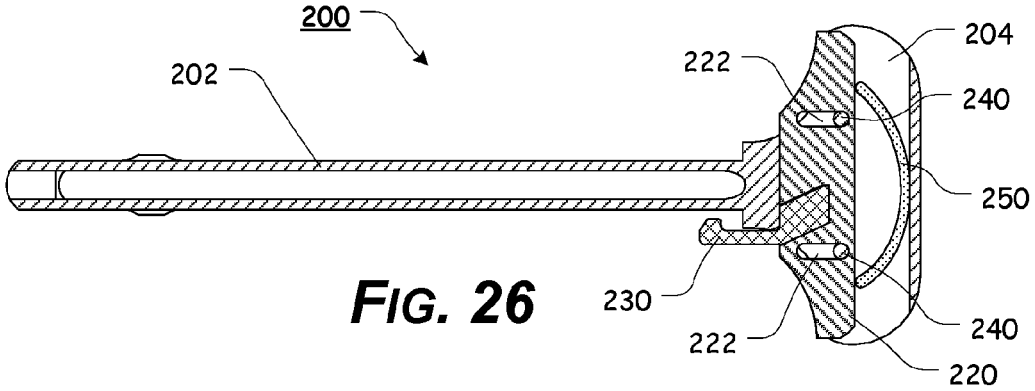
FIG. 26 illustrates a top, cross-sectional view of an exemplary embodiment of an ambidextrous charging handle, wherein the latch element is in the locked position, according to an exemplary embodiment of the present disclosure.
Figure 27:
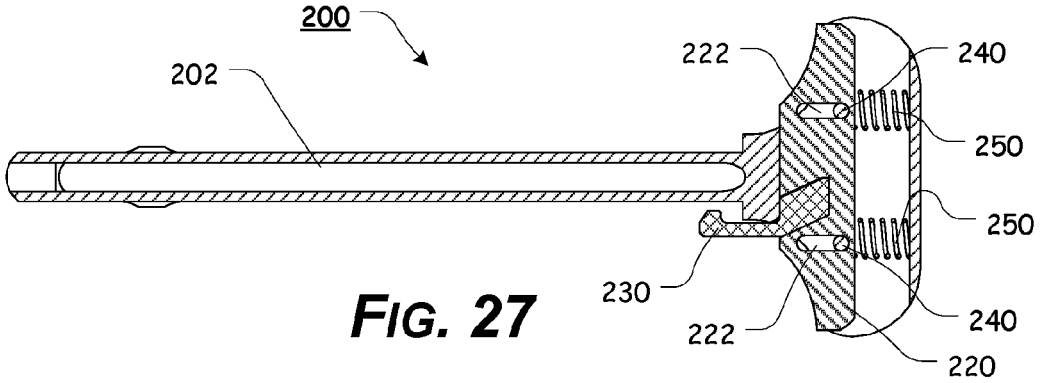
FIG. 27 illustrates a top, cross-sectional view of an exemplary embodiment of an ambidextrous charging handle, wherein the latch element is in the locked position, according to an exemplary embodiment of the present disclosure.
Figure 28:
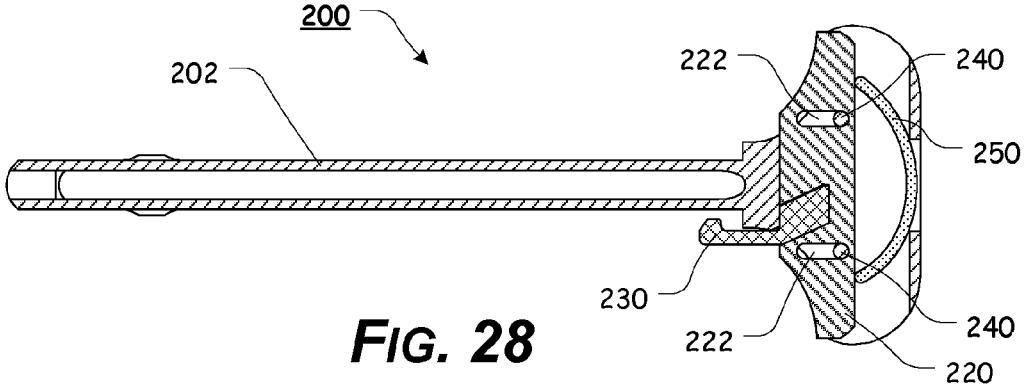
FIG. 28 illustrates a top, cross-sectional view of an exemplary embodiment of an ambidextrous charging handle, wherein the latch element is in the locked position, according to an exemplary embodiment of the present disclosure.
Figure 29:
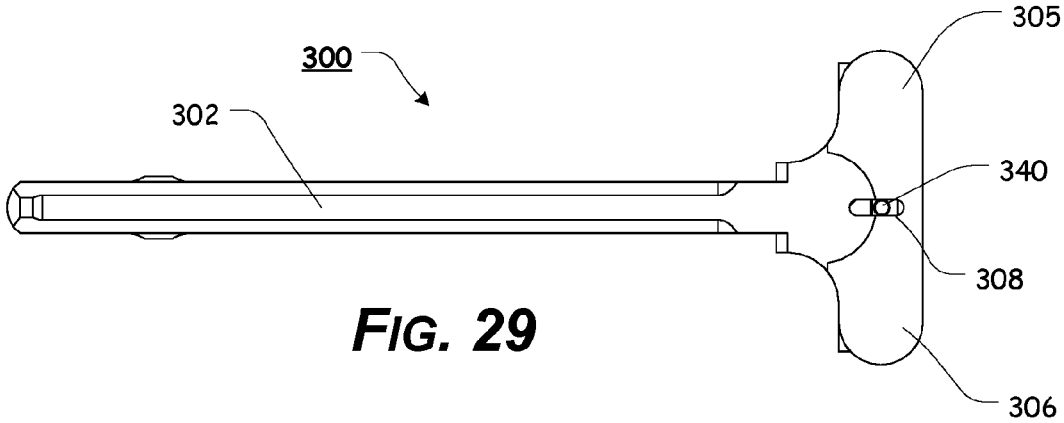
FIG. 29 illustrates a top view of an exemplary embodiment of an ambidextrous charging handle, wherein the latch element is in the locked position, according to an exemplary embodiment of the present disclosure.
Figure 30:
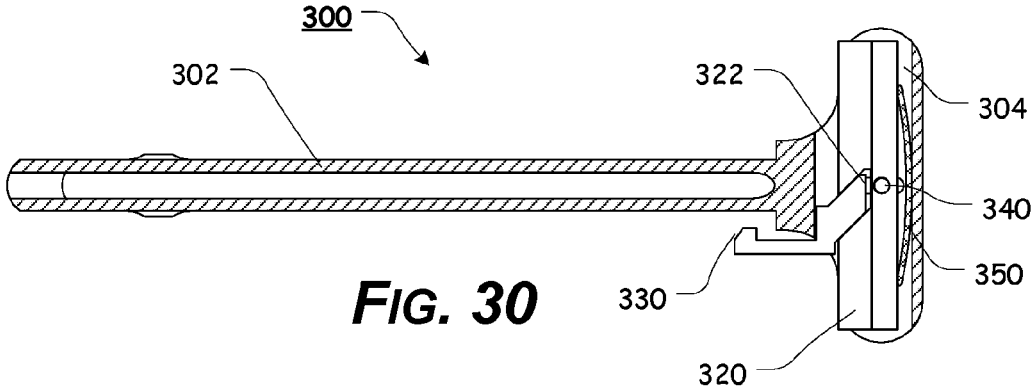
FIG. 30 illustrates a top, cross-sectional view of an exemplary embodiment of an ambidextrous charging handle, wherein the latch element is in the locked position, according to an exemplary embodiment of the present disclosure.
Figure 31:
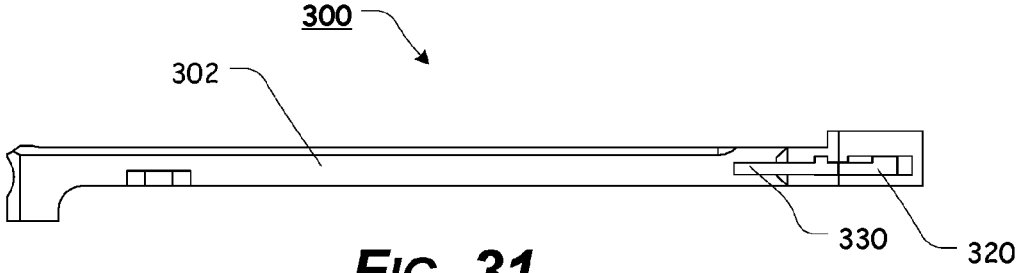
FIG. 31 illustrates a side view of an exemplary embodiment of an ambidextrous charging handle, wherein the latch element is in the locked position, according to an exemplary embodiment of the present disclosure.
Figure 32:
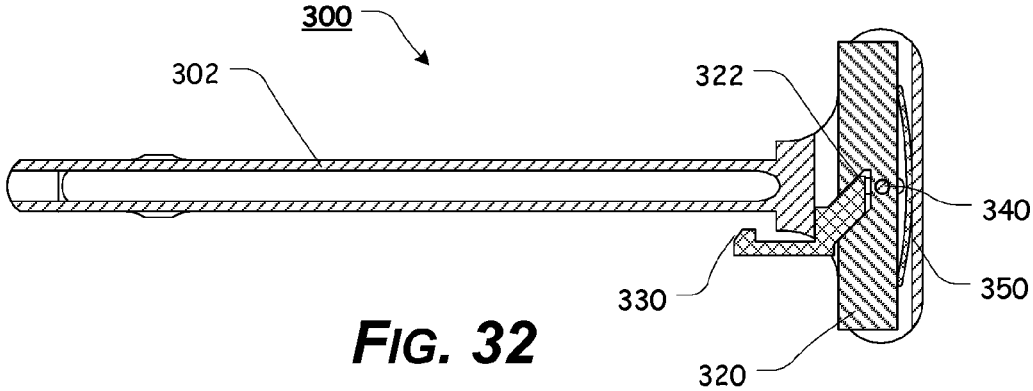
FIG. 32 illustrates a top, cross-sectional view of an exemplary embodiment of an ambidextrous charging handle, wherein the latch element is in the locked position, according to an exemplary embodiment of the present disclosure.

In certain exemplary embodiments, as illustrated in FIGS. 21-22, the charging handle body 102 may be formed as an integral unit. As illustrated in FIG. 23, the charging handle body 102' may be formed of at least two portions of material. A lower handle portion 109' that includes the bolt engagement element 103' is attached or coupled to an upper handle portion 107' to form the charging handle body 102'. Alternatively, as illustrated in FIG. 24, the charging handle body 102" may be formed of at least two portions of material, wherein an upper handle portion 107" that includes the bolt engagement element 103" is attached or coupled to a lower handle portion 109" to form the charging handle body 102". Suitable materials can be used and sections or elements made independently and attached or coupled together, such as by adhesives, welding, screws, rivets, pins, or other fasteners, to form the various elements of the ambidextrous charging handle body 102, 102', and/or 102".

In various exemplary embodiments, various components of the ambidextrous charging handle 100 are substantially rigid and are formed of aluminum. Alternate materials of construction of the various components of the ambidextrous charging handle 100 may include one or more of the following: steel, stainless steel, titanium, and/or other metals, as well as various alloys and composites thereof, glass-hardened polymers, polymeric composites, polymer or fiber reinforced metals, carbon fiber or glass fiber composites, continuous fibers in combination with thermoset and thermoplastic resins, chopped glass or carbon fibers used for injection molding compounds, laminate glass or carbon fiber, epoxy laminates, woven glass fiber laminates, impregnate fibers, polyester resins, epoxy resins, phenolic resins, polyimide resins, cyanate resins, high-strength plastics, nylon, glass, or polymer fiber reinforced plastics, thermoform and/or thermoset materials, and/or various combinations of the foregoing. Thus, it should be understood that the material or materials used to form the various components of the ambidextrous charging handle 100 is a design choice based on the desired appearance and functionality of the ambidextrous charging handle 100.

It should also be understood that the overall size and shape of the ambidextrous charging handle 100 and the various portions thereof is a design choice based upon the desired functionality and/or appearance of the ambidextrous charging handle 100.

FIGS. 25-28 illustrate various elements and/or aspects of an exemplary embodiment of the ambidextrous charging handle 200, of the present disclosure. As shown in FIGS. 25-28, the ambidextrous charging handle 200 comprises at least some of a charging handle body 202, a handle recess 204, a right handle portion 205, a left handle portion 206, a lever element 220, a latch element 230, and two spring biasing elements 250. It should be appreciated that each of these elements (as well as other, similarly named elements of the ambidextrous charging handle 200) correspond to and operate similarly to similarly named elements, as described herein with reference to the ambidextrous charging handle 100 of FIGS. 1-24. Thus, it should be appreciated that the ambidextrous charging handle 200 may incorporate one or any of the features are elements of the ambidextrous charging handle 100 of FIGS. 1-24.

However, as shown in FIGS. 25-28, two elongate lever channels 222 are formed through the lever element 220 (as opposed to the single elongate lever channel 122 formed through the lever element 120). Similarly, two slide protrusions or slide pins 240 (as opposed to a single slide protrusion or slide pin 140) enable the lever element 220 to be slidable forward and/or rearward, relative to the longitudinal axis of the charging handle 200, within the handle recess 204.

FIGS. 29-32 illustrate various elements and/or aspects of an exemplary embodiment of the ambidextrous charging handle 300, of the present disclosure. As shown in FIGS. 29-32, the ambidextrous charging handle 300 comprises at least some of a charging handle body 302, a handle recess 304, a right handle portion 305, a left handle portion 306, a lever element 320, an elongate lever channel 322, a latch element 330, a slide protrusion or slide pin 340, and a spring biasing element 350. It should be appreciated that each of these elements (as well as other, similarly named elements of the ambidextrous charging handle 300) correspond to and operate similarly to similarly named elements, as described herein with reference to the ambidextrous charging handle 100 of FIGS. 1-24. Thus, it should be appreciated that the ambidextrous charging handle 300 may incorporate one or any of the features are elements of the ambidextrous charging handle 100 of FIGS. 1-24.

However, as shown in FIGS. 29-32, the slide protrusion or slide pin 340 interacts with an elongate handle channel 308 formed in one or both of the bottom wall of the handle recess 304 and/or the top wall of the handle recess 304.

FIGS. 33-34 illustrate various elements and/or aspects of an exemplary embodiment of the ambidextrous charging handle 400, of the present disclosure. As shown in FIGS. 33-34, the ambidextrous charging handle 400 comprises at least some of a charging handle body 402, a handle recess 404, a right handle portion 405, a left handle portion 406, a lever element 420, an elongate lever channel 422, a latch element 440, and a spring biasing element 450. It should be appreciated that each of these elements (as well as other, similarly named elements of the ambidextrous charging handle 400) correspond to and operate similarly to similarly named elements, as described herein with reference to the ambidextrous charging handle 100 of FIGS. 1-24. Thus, it should be appreciated that the ambidextrous charging handle 400 may incorporate one or any of the features are elements of the ambidextrous charging handle 100 of FIGS. 1-24.

However, as shown in FIGS. 33-34, two elongate handle channels 408 are formed through the charging handle body 402 (as opposed to the single elongate lever channel 308 formed through the charging handle body 302). Similarly, two slide protrusions or slide pins 440 (as opposed to a single slide protrusion or slide pin 340) enable the lever element 420 to be slidable forward and/or rearward, relative to the longitudinal axis of the charging handle body 402, within the handle recess 404.

FIGS. 35-51 illustrate various elements and/or aspects of an exemplary embodiment of the ambidextrous charging handle 500, of the present disclosure. As shown in FIGS. 35-51, the ambidextrous charging handle 500 comprises at least some of a charging handle body 502, a handle recess 504, a right handle portion 505, a left handle portion 506, one or more slide support surfaces 507, two slide pin apertures 508, a lever element 520, two elongate lever channels 522, a lever recess 525, a latch element 530, a claw 532, a ramp surface 533, a shoulder 534, a latch protrusion 535, two slide protrusions or slide pins 540, and two spring biasing elements 550. It should be appreciated that each of these elements (as well as other, similarly named elements of the ambidextrous charging handle 500) correspond to and operate similarly to similarly named elements, as described herein with reference to the ambidextrous charging handles 100, 200, 300, and/or 400. Thus, it should be appreciated that the ambidextrous charging handle 500 may incorporate one or any of the features are elements of the ambidextrous charging handles disclosed herein.

Figure 50:
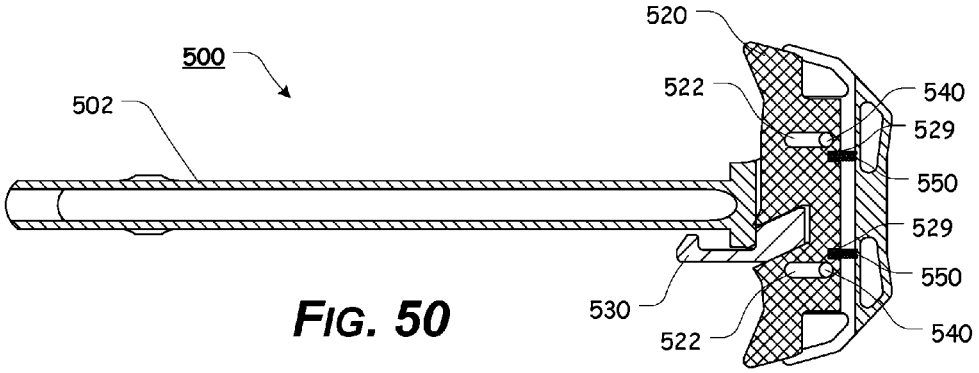
FIG. 50 illustrates a top, cross-sectional view showing various components of an exemplary embodiment of an ambidextrous charging handle, wherein the latch element is in the locked position, according to an exemplary embodiment of the present disclosure.
Figure 51:
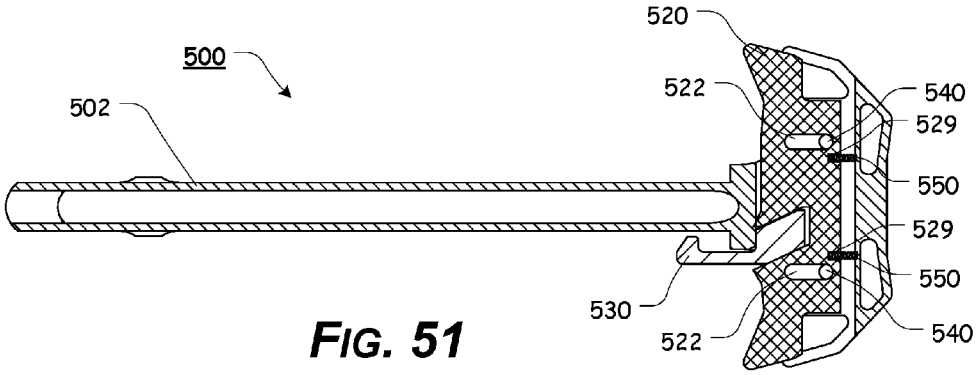
FIG. 51 illustrates a top, cross-sectional view showing various components of an exemplary embodiment of an ambidextrous charging handle, wherein the latch element is in the locked position, according to an exemplary embodiment of the present disclosure.

Additionally, two spring biasing element recesses 529, are formed within a rear portion of the lever element 520 and are sized and shaped so as to receive at least a portion of a spring biasing element 550 therein. The spring biasing elements 550 extend from the spring biasing element recesses 529 so as to contact a wall or other surface defining a portion of the handle recess 504 so as to provide a spring biasing force to the lever element 520, biasing the lever element 520 toward a closed or locked position, as illustrated in FIG. 50.

Figure 52:
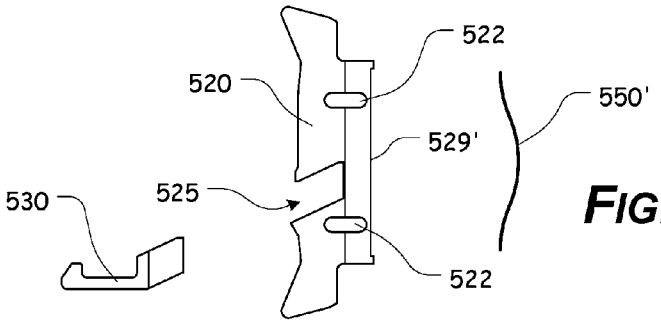
FIG. 52 illustrates a top view of an exemplary embodiment of the lever element, the latch element, and the spring biasing element of an ambidextrous charging handle, according to an exemplary embodiment of the present disclosure.
Figure 53:
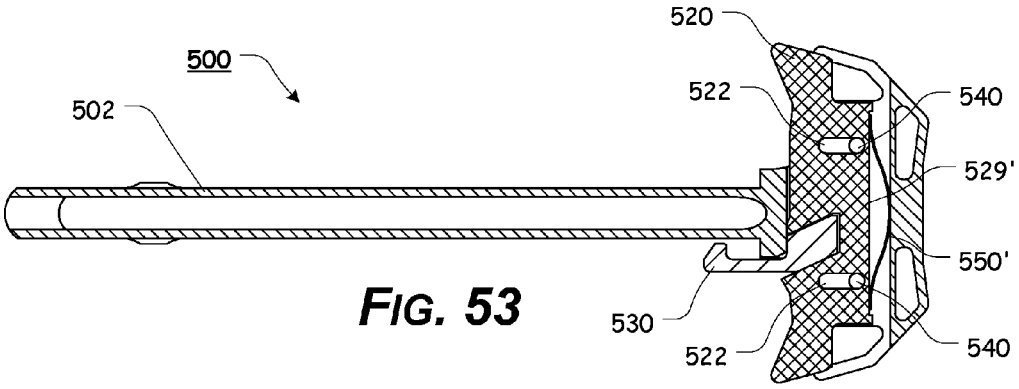
FIG. 53 illustrates a top, cross-sectional view showing various components of an exemplary embodiment of an ambidextrous charging handle, wherein the latch element is in the locked position, according to an exemplary embodiment of the present disclosure.
Figure 54:
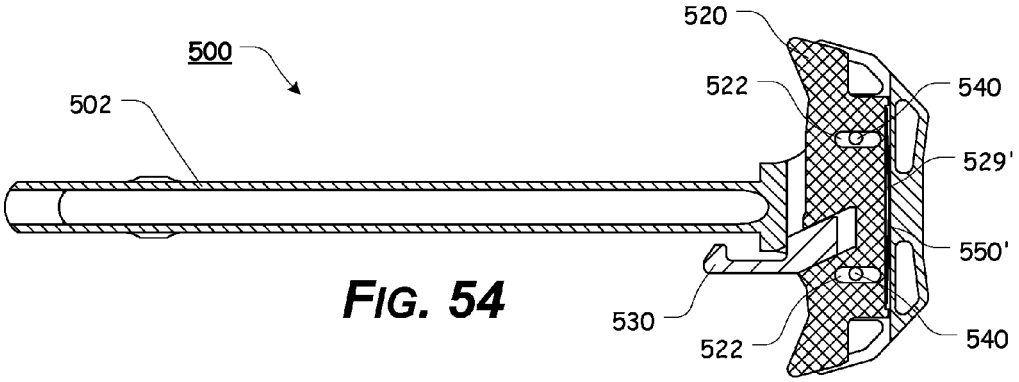
FIG. 54 illustrates a top, cross-sectional view showing various components of an exemplary embodiment of an ambidextrous charging handle, wherein the latch element is in the locked position, according to an exemplary embodiment of the present disclosure.
Figure 55:
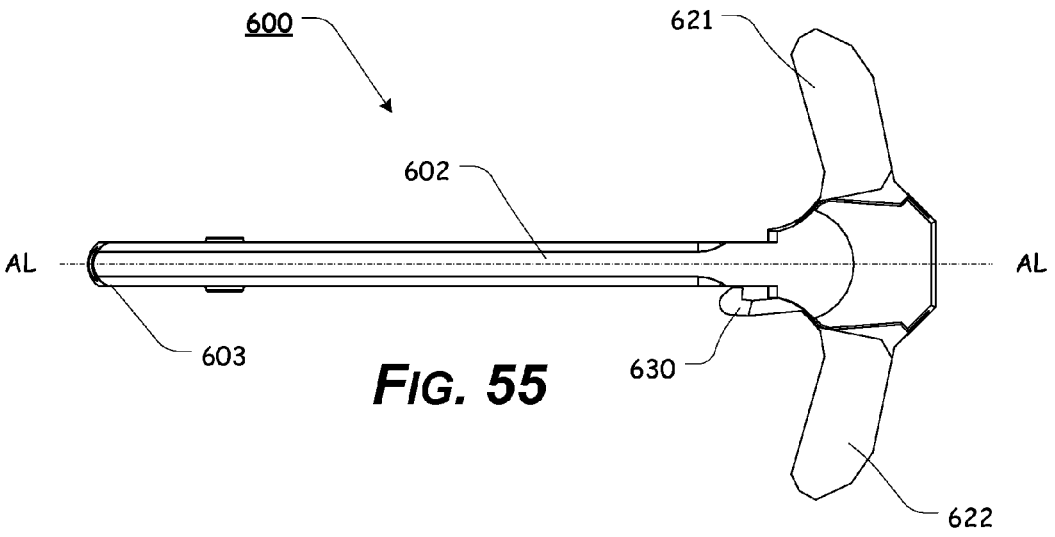
FIG. 55 illustrates a top view of an exemplary embodiment of an ambidextrous charging handle, according to an exemplary embodiment of the present disclosure.
Figure 56:
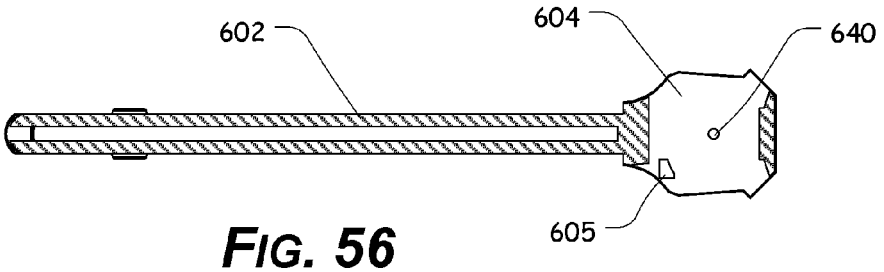
FIG. 56 illustrates a top, cross-sectional view of an exemplary embodiment of the charging handle body, according to an exemplary embodiment of the present disclosure.
Figure 57:
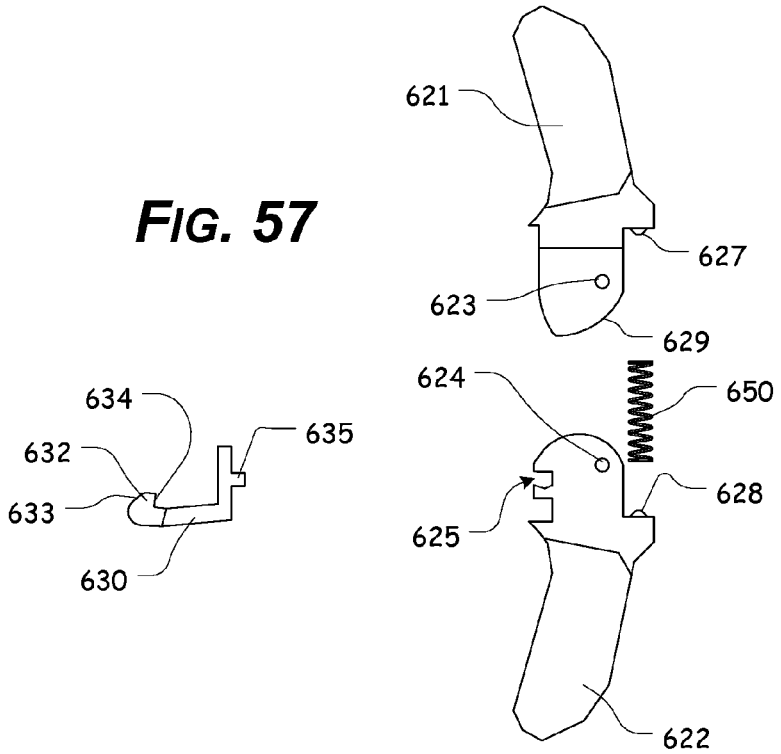
FIG. 57 illustrates an exploded, top view of an exemplary embodiment of the first lever element, the second lever element, the latch element, and the spring biasing element of an ambidextrous charging handle, according to an exemplary embodiment of the present disclosure.
Figure 58:
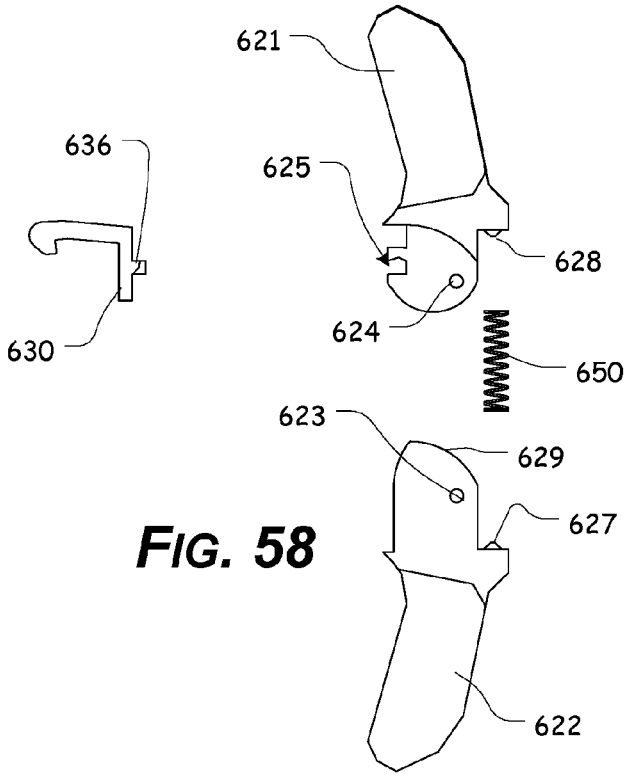
FIG. 58 illustrates an exploded, bottom view of an exemplary embodiment of the first lever element, the second lever element, the latch element, and the spring biasing element of an ambidextrous charging handle, according to an exemplary embodiment of the present disclosure.
Figure 59:
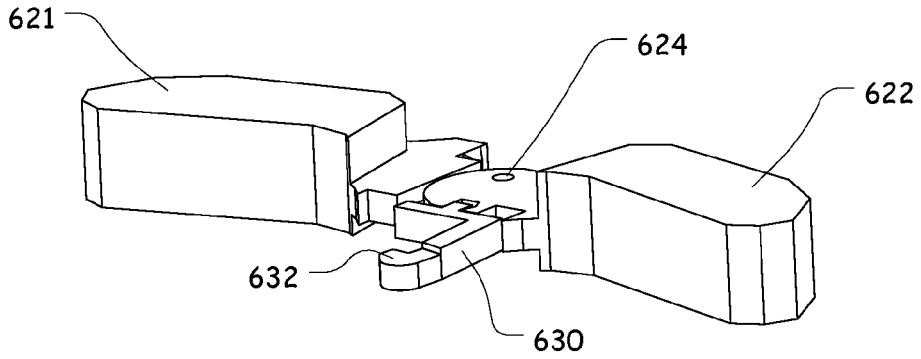
FIG. 59 illustrates upper, front, perspective view of an exemplary embodiment of the first lever element, the second lever element, the latch element, and the spring biasing element of an ambidextrous charging handle, according to an exemplary embodiment of the present disclosure.
Figure 60:
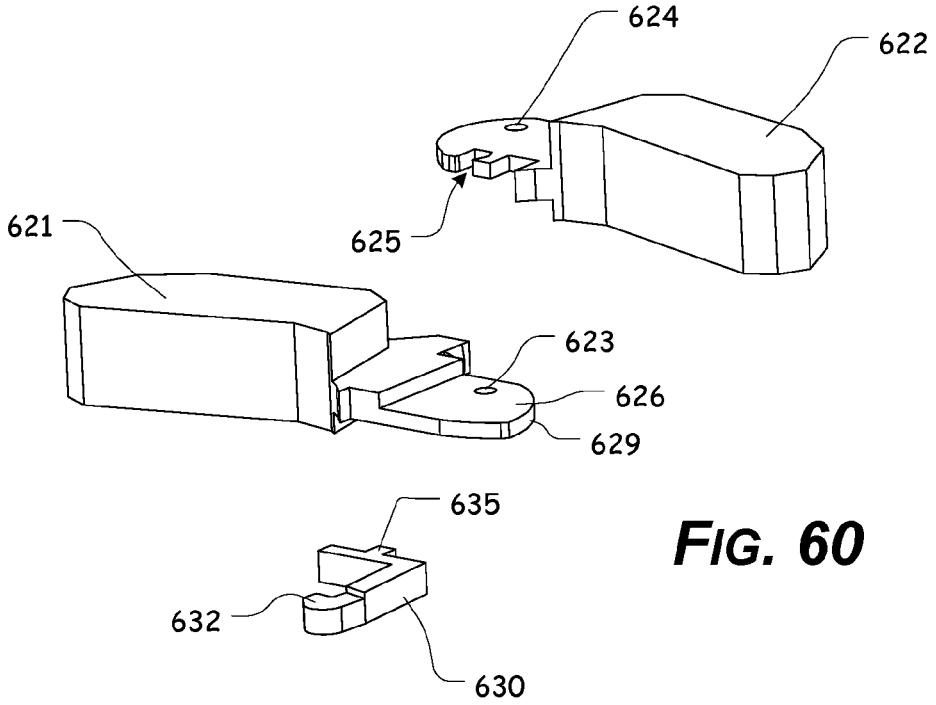
FIG. 60 illustrates an upper, front, exploded, perspective view of an exemplary embodiment of the first lever element, the second lever element, the latch element, and the spring biasing element of an ambidextrous charging handle, according to an exemplary embodiment of the present disclosure.
Figure 61:
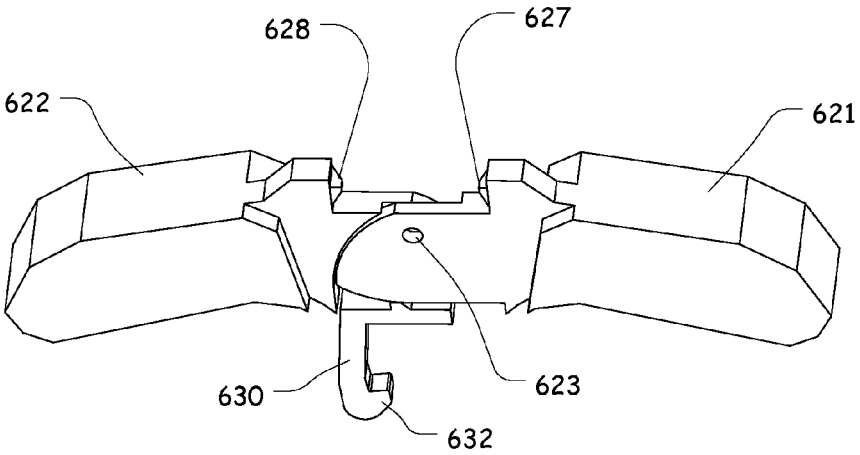
FIG. 61 illustrates lower, rear, perspective view of an exemplary embodiment of the first lever element, the second lever element, the latch element, and the spring biasing element of an ambidextrous charging handle, according to an exemplary embodiment of the present disclosure.
Figure 62:
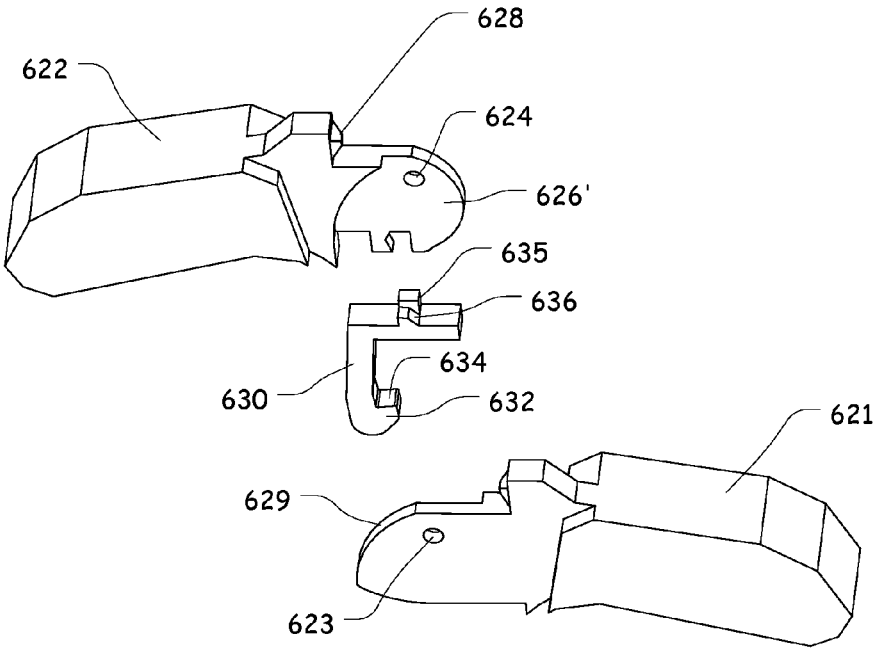
FIG. 62 illustrates lower, rear, exploded, perspective view of an exemplary embodiment of the first lever element, the second lever element, the latch element, and the spring biasing element of an ambidextrous charging handle, according to an exemplary embodiment of the present disclosure.
Figure 63:
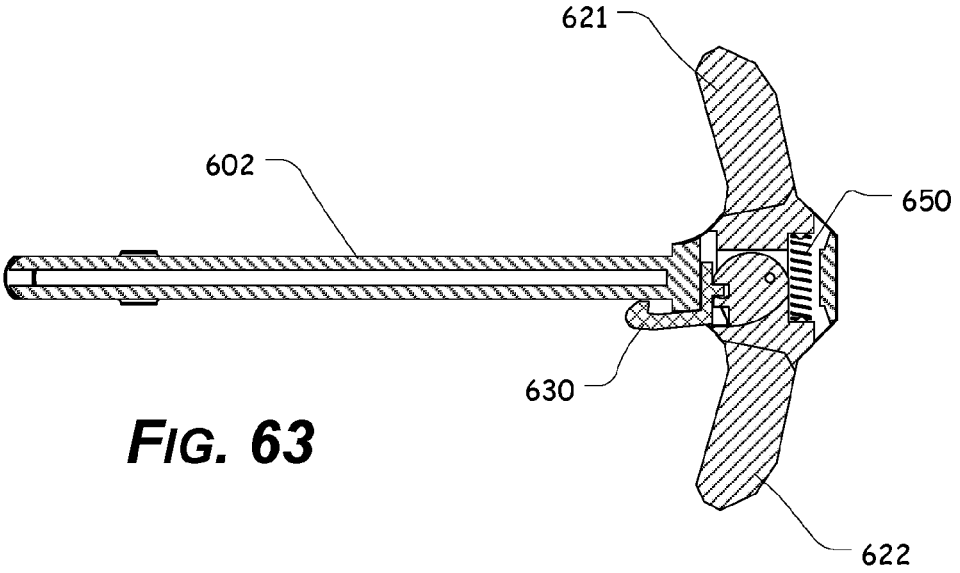
FIG. 63 illustrates a top, cross-sectional view showing various components of an exemplary embodiment of an ambidextrous charging handle, wherein the latch element is in the locked position, according to an exemplary embodiment of the present disclosure.
Figure 64:
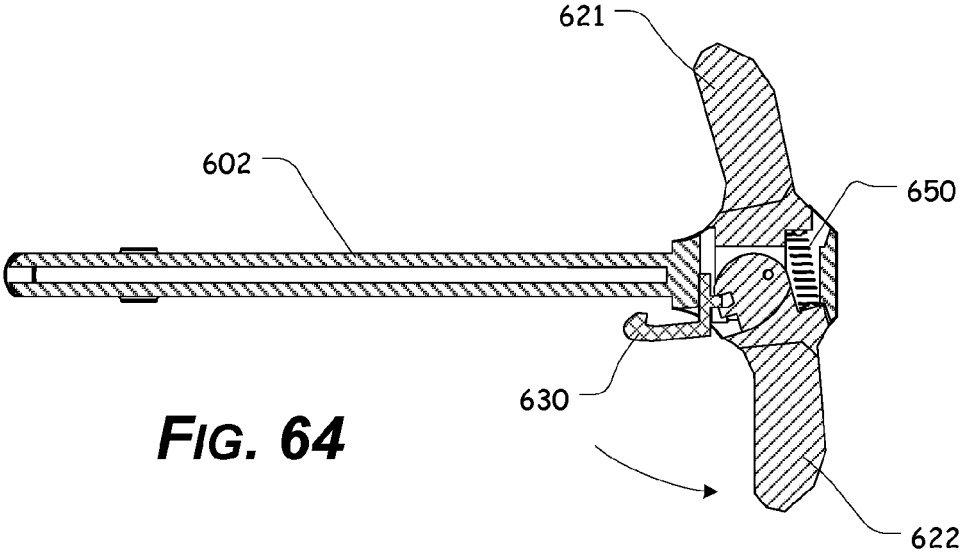
FIG. 64 illustrates a top, cross-sectional view showing various components of an exemplary embodiment of an ambidextrous charging handle, wherein the second lever element is rotated rearward and the latch element is in the unlocked position, according to an exemplary embodiment of the present disclosure.
Figure 65:
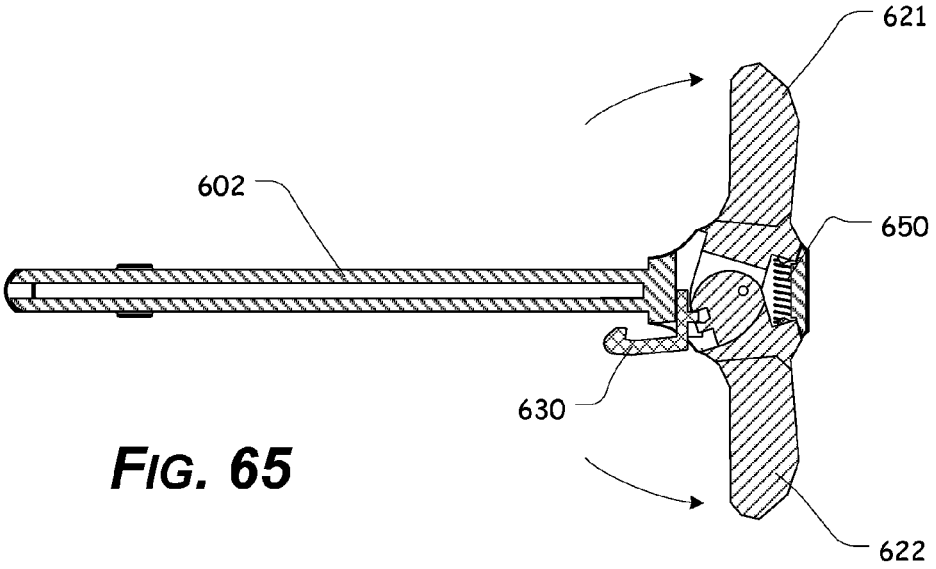
FIG. 65 illustrates a top, cross-sectional view showing various components of an exemplary embodiment of an ambidextrous charging handle, wherein the first lever element is rotated rearward and the latch element is in the unlocked position, according to an exemplary embodiment of the present disclosure.
Figure 66:
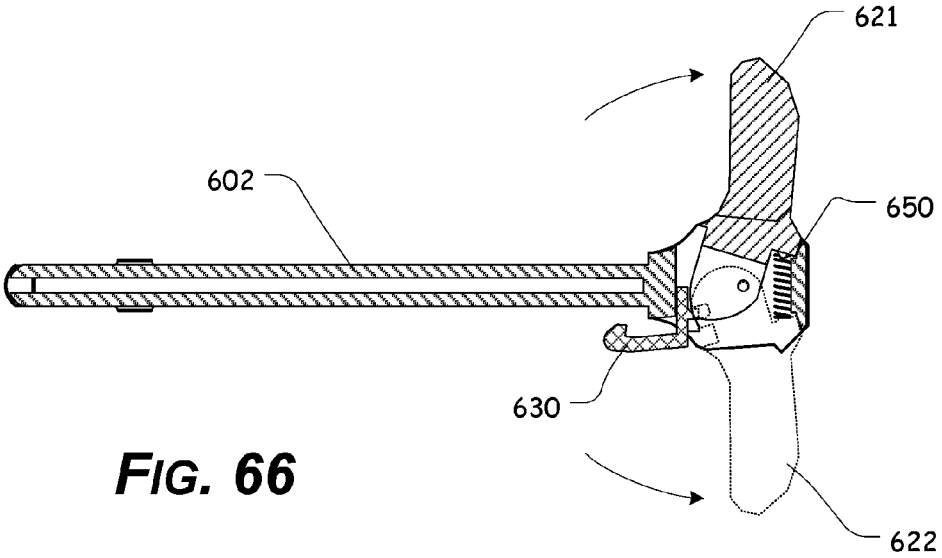
FIG. 66 illustrates a top, cross-sectional view showing various components of an exemplary embodiment of an ambidextrous charging handle, wherein the first lever element is rotated rearward, the latch element is in the unlocked position, and the second lever element is shown in broken lines to further illustrate the interaction of the first lever element and the latch element, according to an exemplary embodiment of the present disclosure.

In certain exemplary embodiments, as illustrated in FIGS. 52-54 illustrate, the spring biasing element recesses 529 are replaced by an elongate spring biasing element channel recess 529' and the coil spring type spring biasing elements 550 are replaced by a curved portion of spring steel or other resilient or biasing element to form a spring biasing element 550'. The elongate spring biasing element channel recess 529' provides a space or area of the lever element 520 formed so as to receive at least a portion of the spring biasing element 550' therein and maintain the relative position of the spring biasing element 550' relative to the lever element 520.

The spring biasing element 550 interacts between an interior side wall of the charging handle body 502 and the lever element 520 to bias the lever element 520 in a forward or locked position. As the lever element 520 is urged rearward, the spring bias of the spring biasing element 550 can be overcome to move the latch element 530 from a locked position, as illustrated in FIG. 53 to an unlocked position, as illustrated in FIG. 54.

FIGS. 55-66 illustrate an exemplary, nonlimiting embodiment of the ambidextrous charging handle 600, according to this disclosure. As illustrated, the exemplary embodiment of the ambidextrous charging handle 600 comprises a charging handle body 602, a latch element 630, a first lever element 621, a second lever element 622, and a spring biasing element 650.

The charging handle body 602 comprises an elongate portion of material that extends along a longitudinal axis from a rear handle portion to a forward end having a bolt engagement element 603. The rear handle portion includes a handle recess 604 formed so as to pivotably receive at least a portion of the latch element 630, the first lever element 621, the second lever element 622, and the spring biasing element 650. The handle recess 604 includes a slide protrusion or slide pin 640 extending from a bottom wall of the handle recess 604. Additionally, a camming element 605 extends from the bottom wall of the handle recess 604.

The latch element 630 extends from a first portion to a second portion and a claw 632 (including a ramp surface 633 and shoulder 634) is formed proximate the first portion of the latch element 630. A primary latch protrusion 635 is formed proximate the second portion of the latch element 630, in a top portion of the latch element 630, while a secondary latch protrusion 636 is formed proximate the second portion of the latch element 630, in a bottom portion of the latch element 630.

The first lever element 621 comprises an elongate portion of material that extends from a latch engagement portion to a finger engagement portion. A pivot aperture 623 is formed through the latch engagement portion, such that when the pivot aperture 623 interacts with the pivot protrusion, the first lever element 621 is able to be pivoted from a locked position to an unlocked position. The first lever element 621 includes a curved, camming surface 629 formed so as to interact with a secondary latch protrusion 636 of the latch element 630. A spring engagement protrusion 627 extends from a portion of the first lever element 621 so as to engage and interact with the spring biasing element 650.

The second lever element 622 comprises an elongate portion of material that also extends from a latch engagement portion to a finger engagement portion. A pivot aperture 624 is formed through the latch engagement portion, such that when the pivot aperture 624 interacts with the pivot protrusion, the second lever element 622 is able to be pivoted from a locked position to an unlocked position. The second lever element 622 includes a lever recess 625 formed so as to interact with a primary latch protrusion 635 of the latch element 630. A spring engagement protrusion 628 extends from a portion of the second lever element 622 so as to engage and interact with the spring biasing element 650.

The first lever element 621 and the second lever element 622 each include recessed surface areas 626 and 626', respectively, within their respective latch engagement portions such that portions of the first lever element 621 and the second lever element 622 are able to overlap one another. By providing overlapping portions, the lever recess 625 and the camming surface 629 are able to more easily interact with the primary latch protrusion 635 and the secondary latch protrusion 636, respectively.

The primary latch protrusion 635 is formed so as to interact with the lever recess 625 of the second lever element 622 such that rotation of the second lever element 622 about the pivot protrusion produces lateral movement of the latch element 630 relative to the longitudinal axis of the charging handle 600.

The secondary latch protrusion 636 is formed so as to interact with the camming surface 629 of the first lever element 621 such that rotation of the first lever element 621 about the pivot protrusion also produces lateral movement of the latch element 630 relative to the longitudinal axis of the charging handle 600. When the camming surface 629 of the first lever element 621 produces movement of the latch element 630 (via interaction of the secondary latch protrusion 636 and the camming surface 629) the primary latch protrusion 635 interacts with the lever recess 625 of the second lever element 622 to produce rotational movement of the second lever element 622.

The spring biasing element 650 interacts between the spring engagement protrusion 627 of the first lever element 621 and the spring engagement protrusion 628 of the second lever element 622 to bias the first lever element 621 and the second lever element 622 against one another in a forward or locked position. As the first lever element 621 and/or the second lever element 622 is urged rearward, the spring bias of the spring biasing element 650 can be overcome to move the latch from the locked to unlocked position.

In various exemplary embodiments, a spring biasing element 650 comprises a spring. However, it should be appreciated that the spring biasing element 650 may comprise a spring, a resilient portion of material, or other element capable of providing a biasing force to the first lever element 621 and/or the second lever element 622.

It should also be appreciated that a more detailed explanation of the instructions regarding how to install and use the ambidextrous charging handle are not provided herein because it is believed that the level of description provided herein will provide sufficient information to enable one of ordinary skill in the art to understand and practice the disclosure, as described.

While the charging handle of the present disclosure has been described in conjunction with the exemplary embodiments outlined above, the foregoing description of exemplary embodiments of the disclosure, as set forth above, are intended to be illustrative, not limiting and the fundamental disclosure should not be considered to be necessarily so constrained. It is evident that the disclosure is not limited to the particular variation set forth and many alternatives, adaptations modifications, and/or variations will be apparent to those skilled in the art.

It is to be understood that the phraseology of terminology employed herein is for the purpose of description and not of limitation. Unless defined otherwise, all technical and scientific terms used herein have the same meaning as commonly understood by one of ordinary skill in the art to which this disclosure belongs.

In addition, it is contemplated that any optional feature of the inventive variations described herein may be set forth and claimed independently, or in combination with any one or more of the features described herein.

Accordingly, the foregoing description of exemplary embodiments will reveal the general nature of the disclosure, such that others may, by applying current knowledge, change, vary, modify, and/or adapt these exemplary, non-limiting embodiments for various applications without departing from the spirit and scope of the disclosure and elements or methods similar or equivalent to those described herein can be used in practicing the present disclosure. Any and all such changes, variations, modifications, and/or adaptations should and are intended to be comprehended within the meaning and range of equivalents of the disclosed exemplary embodiments and may be substituted without departing from the true spirit and scope of the disclosure.

Also, it is noted that as used herein and in the appended claims, the singular forms "a", "and", "said", and "the" include plural referents unless the context clearly dictates otherwise. Conversely, it is contemplated that the claims may be so-drafted to require singular elements or exclude any optional element indicated to be so here in the text or drawings. This statement is intended to serve as antecedent basis for use of such exclusive terminology as "solely", "only", and the like in connection with the recitation of claim elements or the use of a "negative" claim limitation(s).

What is claimed is:

1. A charging handle for a firearm, comprising:

a charging handle body having at least one handle recess formed within said charging handle body;

a lever element having at least one lever recess formed in a portion of said lever element, wherein at least a portion of said lever element is slidable within at least a portion of said handle recess; and a latch element having a latch protrusion extending from at least a portion of said latch element, wherein said latch protrusion is formed so as to interact with at least a portion of said lever recess such that movement of said lever element relative to a longitudinal axis of said charging handle produces lateral translational movement of said latch element relative to said charging handle body.

2. The charging handle of claim 1, wherein said charging handle body comprises an elongate portion of material that extends along said longitudinal axis from a substantially T-shaped rear handle to a forward end having a bolt engagement element.

3. The charging handle of claim 2, wherein said T-shaped rear handle includes a right handle portion and a left handle portion.

4. The charging handle of claim 1, wherein said handle recess further comprises at least one slide protrusion extending through at least a portion of said handle recess, and wherein an elongate lever channel is formed through a portion of said lever element, and wherein a portion of said lever element is slidable within a portion of a handle recess such that at least a portion of said at least one slide protrusion is positioned within said elongate lever channel.

5. The charging handle of claim 4, wherein said slide protrusion comprises a slide pin.

6. The charging handle of claim 1, further comprising a claw formed proximate a first portion of said latch element and said latch protrusion is formed proximate a second portion of said latch element.

7. The charging handle of claim 1, wherein said lever recess is formed at an obtuse angle relative to a longitudinal axis of said lever element.

8. The charging handle of claim 1, further comprising a spring biasing element that biases said lever element to a forward or locked position.

9. A charging handle for a firearm, comprising:

a charging handle body having a handle recess formed within at least a portion of said charging handle body, wherein said handle recess includes at least one elongate handle channel formed through at least a portion of a wall forming said handle recess;

a lever element having a lever recess formed in said lever element, wherein an elongate lever channel is formed through a portion of said lever element, perpendicular to a longitudinal axis of said lever element, and wherein at least a portion of said lever element is slidable within at least a portion of said handle recess such that at least a portion of a slide protrusion is positioned within at least a portion of said elongate handle channel; and a latch element having a latch protrusion formed proximate a second portion of said latch element, wherein at least a portion of said latch protrusion is formed so as to interact with at least a portion of said lever recess such that movement of said lever element along said longitudinal axis of said charging handle produces lateral movement of said latch element relative to said charging handle.

10. The charging handle of claim 9, wherein said charging handle body comprises an elongate portion of material that extends along a longitudinal axis from a substantially T-shaped rear handle to a forward end having a bolt engagement element.

11. The charging handle of claim 10, wherein said T-shaped rear handle includes a right handle portion and a left handle portion.

12. The charging handle of claim 9, wherein said slide protrusion comprises a slide pin.

13. The charging handle of claim 9, wherein said lever recess is formed at an obtuse angle relative to a longitudinal axis of said lever element.

14. The charging handle of claim 9, further comprising a spring biasing element that biases said lever element to a forward or locked position.

15. The charging handle of claim 14, wherein said spring biasing element interacts between an interior side wall of said charging handle body and said lever element to bias said lever element in a forward position.

16. A charging handle for a firearm, comprising:

a charging handle body including an elongate portion of material extending along a longitudinal axis to a bolt engagement element, wherein said charging handle body includes a handle recess formed within a portion of said charging handle body, and wherein said handle recess includes a slide protrusion extending within at least a portion of said handle recess;

a latch element, wherein a primary latch protrusion extends from a portion of said latch element and wherein a secondary latch protrusion extends from a portion of said latch element;

a first lever element, wherein said first lever element extends from a latch engagement portion to a finger engagement portion; wherein a slide pin aperture is formed through said latch engagement portion, such that when said slide pin aperture interacts with said slide protrusion, said first lever element is pivotable from a locked position to an unlocked position, and wherein said first lever element includes a camming surface formed so as to interact with said secondary latch protrusion of said latch element such that rotation of said first lever element about said slide protrusion produces lateral movement of said latch element relative to said longitudinal axis of said charging handle; and a second lever element, wherein said second lever element extends from a latch engagement portion to a finger engagement portion, wherein a slide pin aperture is formed through said latch engagement portion, such that when said slide pin aperture interacts with said slide protrusion, said second lever element is pivotable from a locked position to an unlocked position, wherein said second lever element includes a lever recess formed so as to interact with said primary latch protrusion of said latch element, and wherein said primary latch protrusion is formed so as to interact with said lever recess of said second lever element such that rotation of said second lever element about said slide protrusion produces lateral movement of said latch element relative to said longitudinal axis of said charging handle.

17. The charging handle of claim 16, wherein when said camming surface of said first lever element produces movement of said latch element said primary latch protrusion interacts with said lever recess of said second lever element to produce rotational movement of said second lever element.

18. The charging handle of claim 16, further comprising a spring biasing element, wherein said spring biasing element interacts between said first lever element and said second lever element to bias said first lever element and said second lever element against one another in a forward position.

19. The charging handle of claim 18, further comprising a spring engagement protrusion that extends from a portion of said first lever element so as to engage and interact with said spring biasing element.

20. The charging handle of claim 18, wherein at least a portion of said latch element, said first lever element, said second lever element, and said spring biasing element are pivotably positioned within said handle recess.

* * * * *